US005872581A

United States Patent [19]

Yanagi et al.

[11] Patent Number: 5,872,581

[45] **Date of Patent: *Feb. 16, 1999**

[54] MECHANISM FOR MOUNTING AND REMOVING HEAD MEMBER AND RECORDING APPARATUS PROVIDED WITH SUCH MECHANISM

[75] Inventors: Haruyuki Yanagi, Machida; Tetsuo Suzuki; Hiroyuki Saito, both of Yokohama; Koichi Tanno, Kawasaki; Makoto Kawarama, Kawasaki; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 560,984

[22] Filed: Nov. 20, 1995

[30] Foreign Application Priority Data

Nov. 25, 1994 [JP] Japan ..... 6-291311
Nov. 13, 1995 [JP] Japan ..... 7-294423

[51] Int. Cl.[6] ..... B41J 2/14

[52] U.S. Cl. ..... 347/49

[58] Field of Search ..... 347/49, 220, 197, 347/198, 108, 29, 54, 763

[56] References Cited

U.S. PATENT DOCUMENTS 4,401,990 8/1983 Aiba et al. .
4,426,165 1/1984 Irro .
5,631,690 5/1997 Tashiro et al. ..... 347/220

FOREIGN PATENT DOCUMENTS 0 083 080 7/1983 European Pat. Off. .
0 540 244 5/1993 European Pat. Off. .
0 571 220 11/1993 European Pat. Off. .
0 626 267 11/1994 European Pat. Off. .
0 650 847 5/1995 European Pat. Off. .
2-145359 6/1990 Japan .
7-251547 10/1995 Japan .

*Primary Examiner*—Edward H. Tso
*Attorney, Agent, or Firm*—Fitzpatrick, Cella, Harper & Scinto

[57] ABSTRACT

A recording apparatus includes a carriage capable of mounting and removing a head member, one side portion provided with a positioning unit for the carriage unit to position the head member, a head holding unit for holding the head member, being relatively movable with respect to the one side portion, an operational unit that engages with the head holding unit to move such head holding unit relatively with respect to the one side portion, a first biasing device for biasing the operational unit in the same direction as that in which the head holding member approaches the one side portion, a stopper arranged on the carriage for regulating the biasing force of the first biasing device in a given position, at the same time, causing the biasing force of the first biasing device not to be exerted on the operational unit in the given position, and a second biasing device for biasing the head holding unit in the direction in which such unit parts further away from the one side portion. With the structure thus arranged, a recording head can be removed from the carriage without any additional power from the user or the like once the operational unit is allowed to move to a given position where the stopper acts. The head removal is reliably executable just by one action.

25 Claims, 17 Drawing Sheets

FIG. 9A
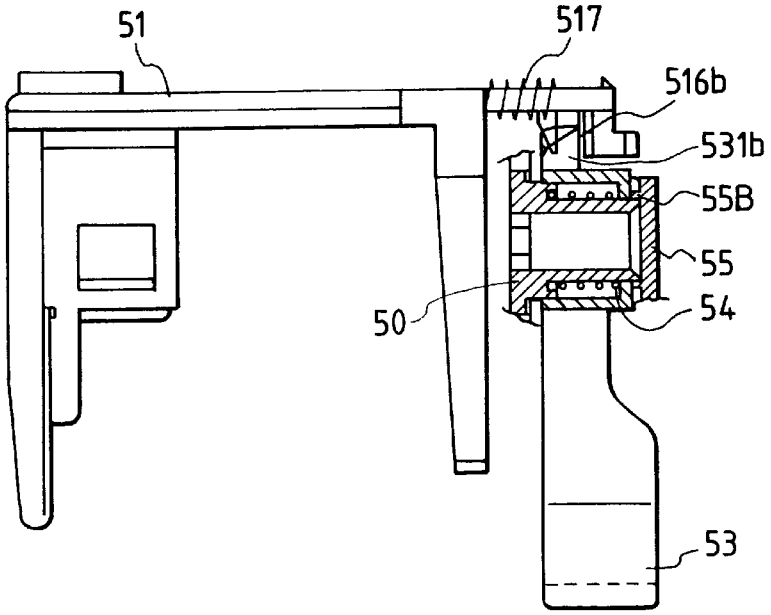
FIG. 9B
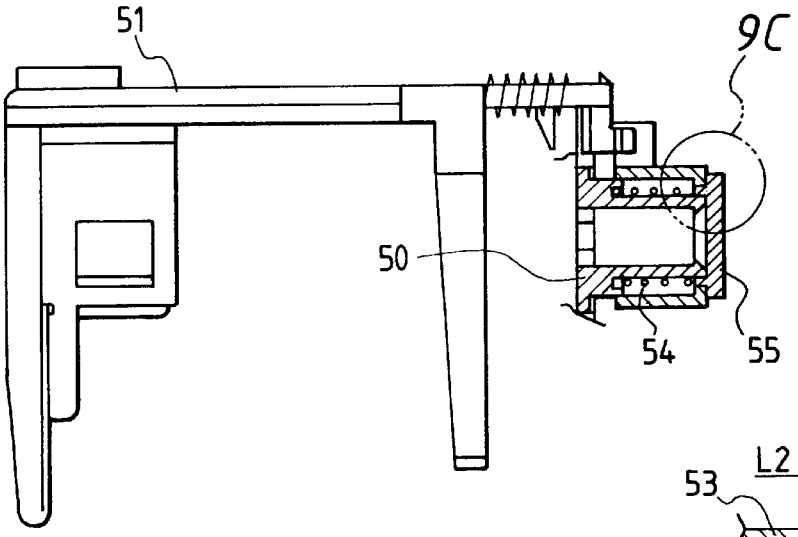
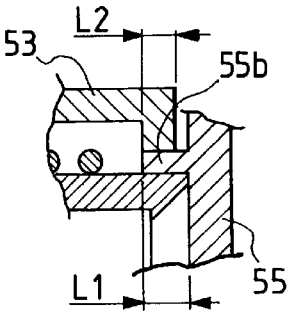
FIG. 9C

MECHANISM FOR MOUNTING AND REMOVING HEAD MEMBER AND RECORDING APPARATUS PROVIDED WITH SUCH MECHANISM

BACKGROUND OF THE INVENTION

1. Field of the Invention

The present invention relates to a head member mounting and removing mechanism for detachably mounting a head member, and a recording apparatus provided with such head member mounting and removing mechanism.

2. Related Background Art

A recording apparatus having the function of a printer, copying machine, facsimile apparatus, or the like or a recording apparatus used as an output device of a complex electronics equipment or a work station, including a computer, word processor, or the like, is structured to record images on a recording material (recording medium) such as paper sheet or thin plastic sheet in accordance with image information. Depending on recording methods, such recording apparatuses are divided into those of ink jet recording type, wire-dot type, thermal type, laser beam type or the like.

For these recording apparatuses, a recording head is mounted on a head mounting unit (a carriage that moves a recording head serially if it is used for a serial printer, for example), and generally, the recording head is detachably mounted on the head mounting unit for the maintenance of the head, among others.

Hereunder, the description will be made of one conventional example of the head member mounting and removing mechanism for detachably mounting a recording head on a head mounting unit.

The recording apparatus described below is an ink jet type recording apparatus (an ink jet recording apparatus) that executes recording by mounting an ink jet recording head on its head mounting unit for recording by discharging ink from the ink discharge ports onto a recording medium. With an ink jet recording head of the kind, it is possible to execute recording of color images in high precision at higher speeds with lesser noises as the advantages and features thereof, and also, perform such recording at lower running costs. Further, as energy generating elements used for discharging ink, electrothermal transducing elements or electromechanical transducing elements are usable, but, particularly, a head using electrothermal transducing elements can be made more compact by the utilization of the semiconductor fabrication processes.

FIGS. 12A to 12D show types of a head cartridge integrally formed with an ink tank, which is regarded as one mode of an ink jet recording head of such kind as described above (hereinafter referred to as a recording head).

As shown in FIGS. 12A to 12D, a recording head 7 comprises an ink tank 73 and a head unit 71. The ink tank 73 is filled with a sponge impregnated with ink. For the head unit 71, there are arranged on an aluminum base plate 72, a silicon plate having a plurality of nozzles in a density of 360 per inch, heater elements, electrodes, and electric wiring formed on the plate, and a head substrate, a liquid chamber, an ink filter, an ink supply tube, and others.

As a structure to mount a recording head 7 such as described above on a recording apparatus main body, there has been proposed in Japanese Laid-Open Patent Application No. 7-251547 a structure which will be described below.

FIGS. 13A to 13C are front views of the carriage unit having a recording head 7 shown in FIG. 12 mounted on it.

FIGS. 14A and 14B are front views which show a mounting and removing mechanism for the recording head 7: FIG. 14A illustrates the state where the head is set; and FIG. 14B illustrates the state where the head is released. FIG. 15 is a side view which illustrates the structure of the contacting portion and others of the carriage unit.

As shown in FIGS. 13A to 13C, a head holder 51 that serves as a unit for holding the head is structured to mount the recording head 7 on it along a guide (not shown) arranged on the carriage 50, and to make it slidable in the left and right directions as looking at FIGS. 13A to 13C. For the head holder 51, a pressure unit 512 is provided to press the recording head 7 to the contact surface 503 and the positioning surface 504 (see FIG. 15) of the side plate 502 that forms one side portion planted vertically on the guide unit 511 in order to guide the recording head 7 and the carriage 50. Also, a guide arm 513 is arranged in a position opposite to the pressure unit 512 of the head holder 51. This guide arm 513 acts upon the recording head 7 when the head 7 is parted from the contact surface 503.

An operational hook lever 53 is rotatively fixed to the side plate 502 of the carriage 50. On the rotational center of the hook lever 53, a contact spring 54 is arranged to bias the hook lever 53 in the direction indicated by an arrow in FIGS. 13A to 13C. A hook cover 55 is fixed to cover the hook lever 53 so as not to allow the hook lever 53 to fall off from the carriage 50. As shown in FIG. 14A and 14B, the hook lever 53 and the head holder 51 are respectively provided with cams 516 and 531 that can abut upon each other. It is arranged that with the rotation of the hook lever 53, the head holder 51 is caused to shift in the left and right directions as looking at FIGS. 14A and 14B. Also, the biasing force of the contact spring 54 is exerted through the hook lever 53 to press the recording head 7 on the head holder 51.

As shown in FIG. 15, on the side plate 502 of the carriage 50, positioning fixtures 505*a* and 505*b* are arranged to position the recording head 7. Further, a contact unit is provided for the side plate to make the electrical contact possible with respect to the recording head 7.

Now, with reference to FIGS. 13A to 13C, the description will be made of the mounting and removing operations of the recording head 7 on and from the carriage 50 structured as described above.

In order to mount the recording head 7, the hook lever 53 is raised in the upper direction in FIG. 13B as looking at FIG. 13B so that the head holder 51 is caused to shift to the left to make it ready for a recording head to be mounted. In this state, the recording head 7 is mounted, and then, the hook lever 53 is rotated in the lower direction in FIG. 13A as looking at FIG. 13A to cause the head holder 51 to shift to the right side together with the recording head 7. In this way, the recording head 7 is positioned to make the electrical contact and related operations possible. In this state, the image formation is ready for a sheet material P to be used.

On the other hand, when the recording head 7 is removed from the carriage unit 15, the hook lever 53 is again raised in the upper direction in FIG. 13B as looking at FIG. 13B so as to shift the head holder 51 to the left side. Thus the guide arm 513 of the head holder 51 presses the recording head 7 to the left side, and then, the recording head 7 is made removable from the carriage unit 15.

However, in the carriage structured in accordance with the prior art, the hook lever abuts upon the hook cover due to the biasing force of the contact spring if the hook lever is raised as shown in FIG. 14B, because the cam that has checked the biasing force of the contact spring in the direction indicated by an arrow is caused to release its engagement. Therefore, the following problems are encountered when operating the mounting and removal of a recording head.

(1) Although the removal of the recording head is possible in a state that the hook lever has been raised, it is necessary for the user to continuously operate the hook lever until the lever is positioned upward.

(2) In order to obtain the released condition just by the user's slight upward pull of the hook lever, a spring should be provided for biasing the head holder in the releasing direction. However, since the contact spring has biased the hook lever to the hook cover side, there is a need for making the biasing force of such spring greater because of the fact that resistance to slide is present between the hook lever and hook cover.

If the biasing force of the aforesaid spring is made greater in order to overcome such resistance to sliding thus existing, the biasing force of the aforesaid contact spring cannot function as the pressure acting upon the head holder through the operation of the hook lever. Therefore, the pressure of the contact spring should be made greater. Then the problem again arises that the aforesaid resistance to sliding becomes greater still.

SUMMARY OF THE INVENTION

The present invention is designed in consideration of the technical problems encountered in the prior art described above. It is an object of the invention to provide a recording apparatus capable of removing a head member from a carriage or operating its mounting to the carriage just by one action with a simple and space-saving structure that enhances the operativity of the apparatus at the same time.

It is another object of the invention to provide a recording apparatus capable of reliably operating the mounting of a head member to and the removal thereof from a carriage with a simple and space-saving structure.

It is still another object of the invention to provide a recording apparatus having the following elements among those constituting its structure:

a carriage unit capable of mounting and removing a head member;

one side portion provided with a positioning unit for said carriage unit to position the head member;

a head holding unit for holding the head member, being relatively movable with respect to the aforesaid one side portion;

an operational unit that engages with the head holding unit to move such head holding unit relatively with respect to the aforesaid one side portion;

biasing means for biasing the operational unit in the same direction as the direction in which the head holding member approaches the aforesaid one side portion;

stopper means arranged on the carriage for regulating the biasing force of such biasing means in a given position, at the same time, causing the biasing force of such biasing means not to be exerted on the operational means in said given position; and second biasing means arranged on the carriage for biasing the head holding unit in the direction in which such unit parts further away from said one side portion.

It is a further object of the invention to provide a recording apparatus including the following:

a carriage on which a recording head for the formation of images on a recording medium is detachably mountable;

one side portion provided with a positioning unit for the carriage unit to position the recording head, and a contact unit for making the electrical contact with the recording head;

a head holding unit to hold the head member, being relatively movable with respect to the aforesaid one side portion;

an operational unit arranged to engage with the head holding unit to shift the head holding unit relatively with respect to the aforesaid one side portion;

biasing means for biasing the operational unit in the same direction as the direction in which the head holding unit approaches the aforesaid one side portion;

stopper means provided for the carriage to regulate the biasing force of the aforesaid biasing means in a given position, at the same time, checking the biasing force of the biasing means in the aforesaid given position so as not to allow it to act upon the operational unit; and second biasing means provided for the carriage to bias the head holding unit in the direction in which such unit parts from the aforesaid one side portion.

BRIEF DESCRIPTION OF THE DRAWINGS

FIGS. 9A to 9C are views which illustrate the operation of the recording head mounting and removing mechanism of the recording apparatus in accordance with a second embodiment of the present invention.

FIG. 14A shows a state at the time of head being mounted and FIG. 14B shows a state at the time of head being removed.

DESCRIPTION OF THE PREFERRED EMBODIMENTS

Figure 1:
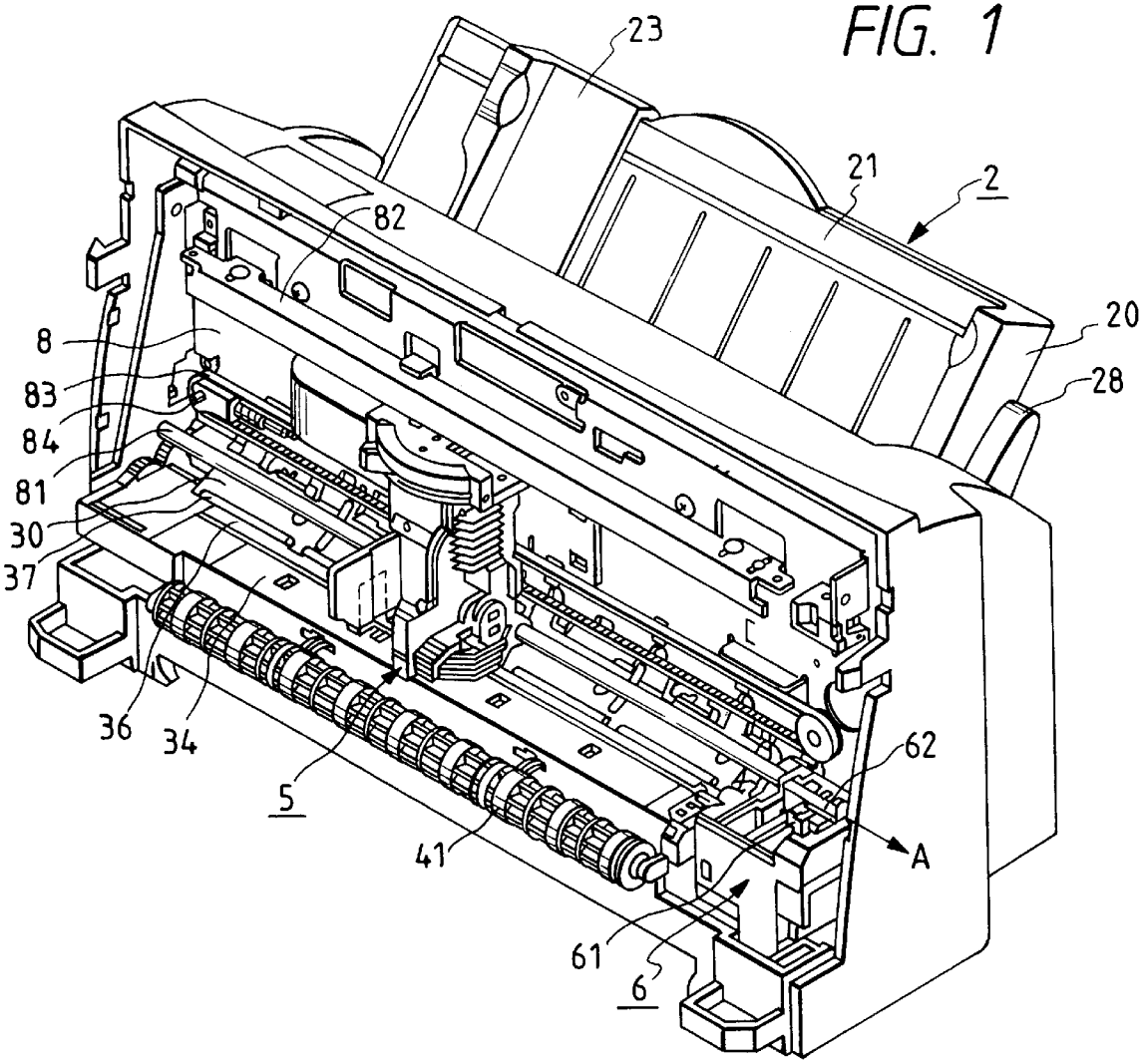
FIG. 1 is perspective view which shows the entire structure of a recording apparatus in accordance with a first embodiment of the present invention.

Hereinafter, with reference to the accompanying drawings, the description will be made of each of the embodiments in accordance with the present invention.

In this respect, a recording apparatus to which the present invention is applicable may be the one provided with a reading head or a recording head mounted on a head mounting unit, which is capable of reading or recording with respect to a sheet member arranged on a recording area facing the head member thus mounted. This apparatus may be the one that its head mounting unit has at least one mode wherein such unit is provided with a mounting and removing position for detachably mounting the head member on the head mounting and removing member, and a mounting position for positioning and mounting the head member with respect to the head mounting and removing member.

Also, when a recording apparatus to which the present invention is applicable adopts a recording head as its head member, it may be possible to adopt a mode wherein a recording head and an ink tank that supplies ink to the recording head are integrally formed and mounted on the head mounting unit together; a mode wherein a recording head and an ink tank are arranged as separate bodies, and a recording head having an ink tank holder is mounted on the head mounting unit, while mounting the ink tank on an ink tank holder; or a mode wherein only a recording head is mounted on the head mounting unit, while an ink tank is provided for a recording apparatus main body side. Further, it may be possible to adopt a mode wherein a pressure member presses an ink tank to shift it toward a recording head that has been already mounted on a head mounting unit, thus completing its positioning and mounting. Here, even in these cases, it should be preferable to adopt a mode wherein an electrical contact unit on the recording head side and an electrical contact unit on the head mounting unit are electrically connected with each other in the mounting position of the recording head in order to obtain a good electrical connection assuredly.

Now, before describing each of the embodiments in detail, the overall outline will be given below.

At first, if a recording head has been already mounted on a carriage unit, the head holding unit having the recording head held thereon is positioned on one side portion so that the recording head is in a state where it is electrically connected with the contact unit arranged on this one side portion, and also, positioned by means of the positioning unit arranged on this one side portion.

Then, when the user or the like moves the operational unit to release this state for the removal of the recording head from the carriage unit, the head holding unit begins to shift in the direction in which it parts further away from the one side portion because this unit is interlocked with the operational unit. At the same time, the operational unit begins to shift in the direction in which it approaches the one side portion because of the biasing force exerted on it by biasing means. After that, in a given position on the way of this shift actuated by the force exerted by biasing means of the operational unit, stopper means is caused to check such force exerted by the biasing means, and brings the operational unit in such a state that no biasing force acts upon it at all. At this juncture, the head holding unit is being biased by second biasing means continuously in the direction in which it parts further away from the one side portion. Therefore, through the head holding unit, the biasing force exerted by the second biasing means acts upon the operational unit that has become free from the biasing force from the biasing means as described above. As a result, along the shift of the head holding unit by the exertion of biasing force of the second biasing means, the operational unit becomes movable without any additional force from the user or the like for its movement. In this way, the recording head can be removed from the carriage unit: thus the removal of the recording head from the carriage unit is possible just by one action.

Also, in this case, the recording head is allowed to shift to the removal position on the carriage by the biasing force that has been elastically applied without obtaining any force from the user for this movement. As a result, the recording head can shift to the head removal position reliably. There is no possibility that any damage is invited by the event that the recording head is hung up on a part of the carriage on the way of removal and left intact in such an unstable state on the carriage.

On the other hand, when the user or the like shifts the operational unit for mounting and fixing the recording head on the carriage unit, the head holding unit can shift together with the head held thereon to the one side portion by means of the engagement with the operational unit as in the case of the conventional art regarding the carriage unit. Thus the recording head is electrically connected with the contact unit arranged on the one side portion, and at the same time, positioned by the positioning unit also arranged on the one side portion. In this state, the operational unit and head holding unit are kept in the respective positions.

Figure 13B:
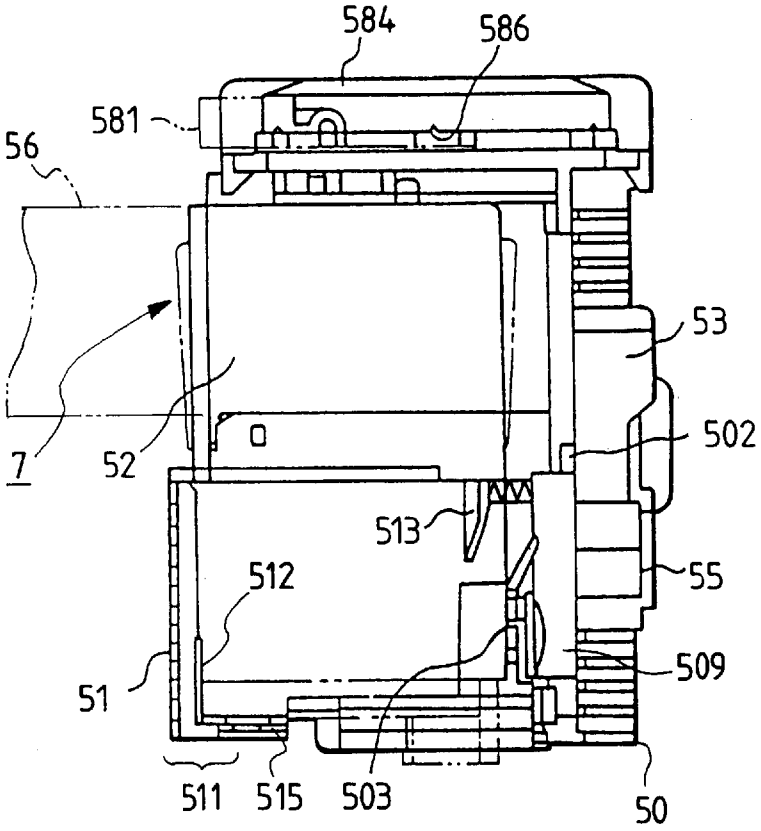
FIGS. 13A to 13C are views illustrating the operation of mounting a recording head (head cartridge) on a carriage.
Figure 13A:
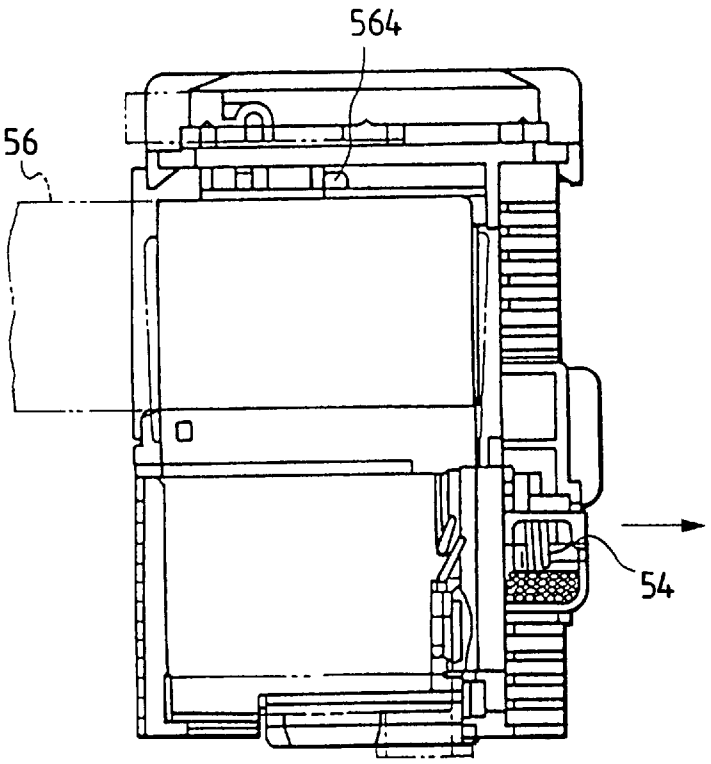

Also, while the description has been made of the case where the operation is executable by one action for removing the recording head or the like from the carriage, it is also possible to execute an operation by one action for mounting a recording head or the like on a carriage by, for example, modifying the positional arrangement of the electrical connector and others of a carriage represented in FIGS. 13A to 13C, which will be described later, so that the position shown in FIG. 13A is arranged as the one for removing the recording head, and the position shown in FIG. 13B arranged as the one where recording is made executable. In this case, with a simplified and space-saving structure, a recording head is reliably mounted on the position to make the head ready for the execution of recording.

(First Embodiment)

Figure 2:
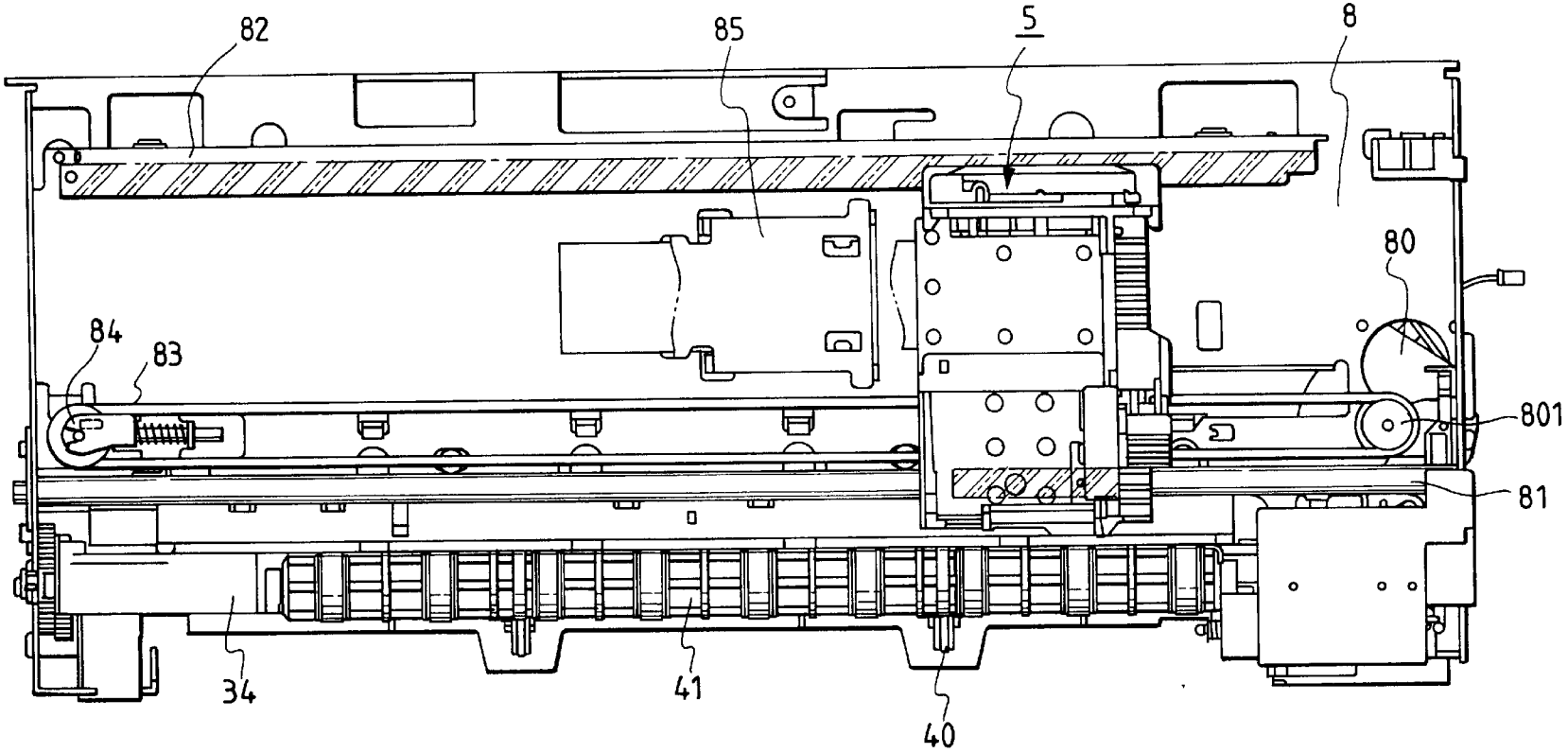
FIG. 2 is a front view of the recording apparatus represented in FIG. 1.
Figure 3:
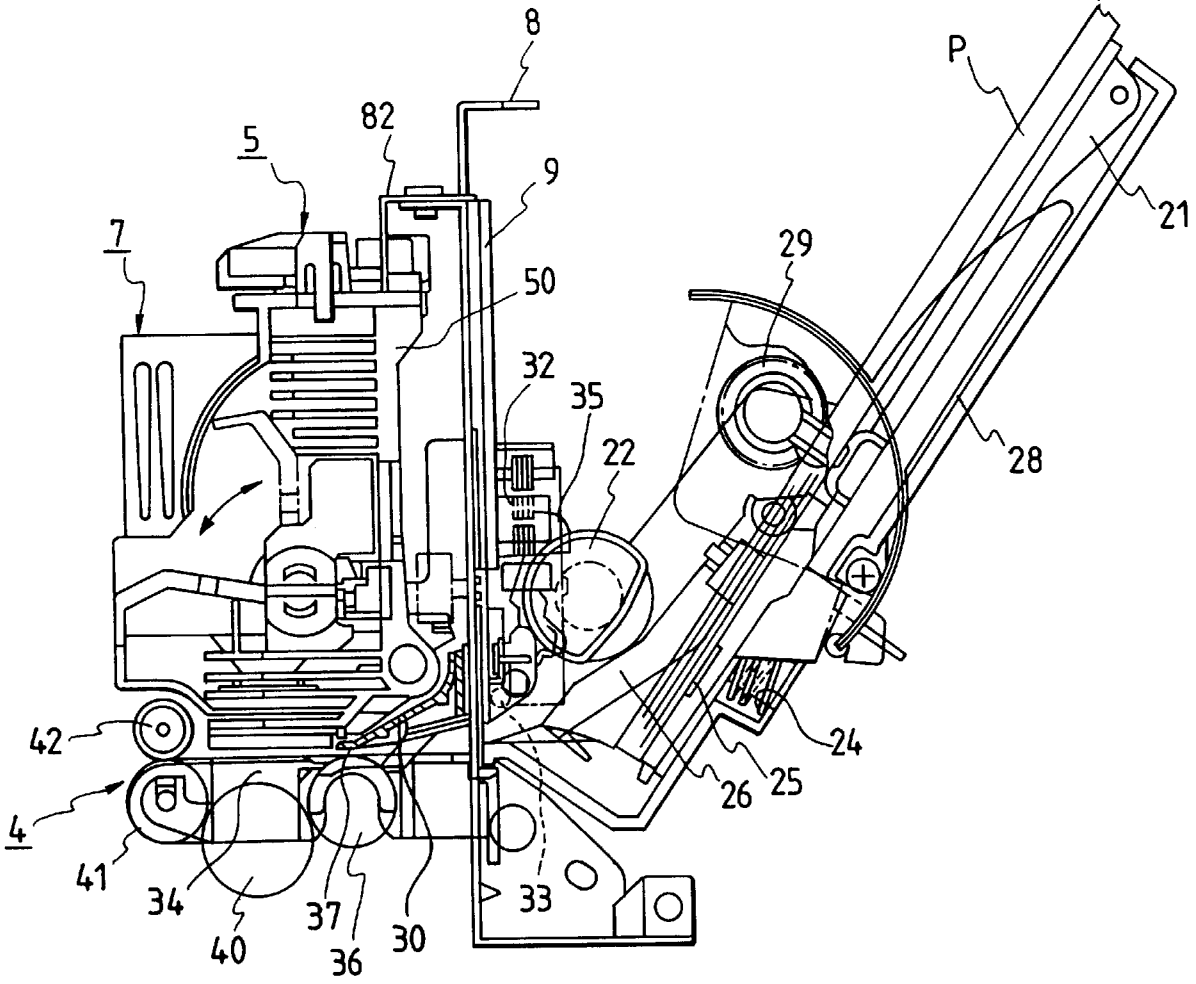
FIG. 3 is a cross-sectional view which shows the structure of the recording apparatus represented in FIG. 1.

FIG. 1 is a perspective view which shows the entire structure of a recording apparatus in accordance with a first embodiment of the present invention. FIG. 2 is a plan view showing the recording apparatus represented in FIG. 1. FIG. 3 is a cross-sectional view showing the recording apparatus represented in FIG. 1.

As shown in FIG. 1 to FIG. 3, a recording apparatus 1 having an automatic sheet feeder installed on it comprises a sheet supply unit 2; sheet feed unit 3; sheet exhaust unit 4; carriage unit 5; and cleaning unit 6. Now, with reference to FIG. 1 to FIG. 3, brief descriptions will be made one by one in accordance with each item as given below.

(A) Sheet supply unit

The sheet supply unit 2 is structured to install on a base 20 a pressure plate 21 for stacking each sheet material P, and a sheet supply rotator 22 for supplying each sheet material P. On the pressure plate 21, a movable side guide 23 is movably mounted to regulate the stacking position of each of the sheet materials P. The pressure plate 21 is rotative centering a rotational shaft coupled to the base 20, and biased by a pressure plate spring 24 to the sheet supply rotator 22. On a location of the pressure plate 21 facing the sheet supply rotator 22, a separate pad 25 is provided. This pad is formed by an artificial leather or the like having a large friction coefficient in order to prevent the sheet materials P from being superposed when supplying each of them. Further, on the base, there are arranged a separation nail 26 to separate the recording sheets P one by one by covering the corner portion of a sheet material P in one direction; a bank portion 27 integrally formed with the base 20 to separate cardboards or the like that cannot be separated by use of the separation nail 26; a switch over lever 28 to enable the separation nail 26 to function in the position set for an ordinary sheet, and disable the separation nail 26 to function in the position set for a cardboard or the like; and a release cam 29 to release the engagement of the pressure plate 21 and sheet supply rotator 22.

With the structure described above, the release cam 29 presses down the pressure plate 21 on standby. The engagement between the pressure plate 21 and sheet supply rotator 22 is released. Then, the driving force of a feed roller 36 is transmitted in this state to the sheet supply rotator 22 and release cam 29 through gears and others. The release cam 29 parts from the pressure plate 21 to allow the pressure plate 21 to rise, thus the sheet supply rotator 22 and the sheet material P abut upon each other to pick up the sheet material P along the rotation of the sheet supply rotator 22 to start supplying the sheet. The separation nail 26 separates the sheets thus supplied and transfers them one by one to the sheet feed unit 3. The sheet supply rotator 22 and release cam 29 continue their rotation until the sheet material P is transferred to the sheet feed unit 3, and then, the driving force from the feed roller 36 is cut off when the rotator and cam are again on standby where the engagement of the recording sheet P and the sheet supply rotator 22 is released.

(B) Sheet feed unit

The sheet feed unit 3 comprises a feed roller 36 to feed the sheet material P, and a PE sensor 32. A pinch roller 37 to follow the rotation of the feed roller 36 is arranged to abut upon it. The pinch roller 37 is supported by a pinch roller guide 30, and biased by a pinch roller spring 31, thus creating feeding force applicable to the sheet material P when the pinch roller 37 is caused to be in contact with the feed roller 36. Further, an upper guide 33 and a platen 34 are arranged for guiding the sheet material P at the entrance of the sheet feed unit 3 to which the sheet material P is being supplied. Also, for the upper guide 33, a PE sensor lever 35 is arranged to detect the leading end and trailing end of the sheet material P and transmit the result of such detection to the PE sensor 32. Further, on the downstream side of the feed roller 36 in the feeding direction of the recording sheet, a recording head 7 is arranged to form images in accordance with imaging information.

With the structure described above, the sheet material P supplied to the sheet feed unit 3 is guided by means of the platen 34, pinch roller guide 30, and upper guide 33, and transferred to the roller pair of the feed roller 36 and pinch roller 37. At this juncture, the PE sensor lever 35 detects the leading end of the sheet material P to obtain the printing position of the sheet material P. Also, the sheet material P is being fed on the platen 34 by the rotation of the roller pair 36 and 37 driven by a LF motor (not shown).

Here, for the recording head 7, an ink jet recording head is used, which is formed integrally with an ink tank to make its replacement easy. This recording head 7 is arranged to make it possible to heat ink by means of heaters that function as electrothermal transducing elements. With this heating, ink is caused to create film boiling, and by the development or contraction of air bubbles brought about by this film boiling, pressure changes are generated to discharge ink from the nozzles 70 of the recording head 7, hence forming images on the sheet material P.

(C) Carriage unit

The carriage unit 5 is provided with a carriage 5 on which a recording head 7 is mounted.

The carriage 50 is supported by the guide rail 82 that maintains a gap between the recording head 7 and sheet material P by holding the rear end of the carriage 50 and the guide shaft 81 arranged to enable the carriage to reciprocate its scanning in the direction intersecting or preferably at right angles to the feeding direction of the sheet material P. In this respect, the guide shaft 81 and guide rail 82 are mounted on the chassis 8. Also, the carriage 50 is driven by means of a carriage motor 80 fixed to the chassis 8 through a timing belt 83. The timing belt 83 is tensioned around and supported by an idle pulley 84. Further, the carriage 50 is provided with a flexible board 56 to transmit head signals from an electrical circuit board 9 to the recording head 7.

With the structure described above, the roller pair 36 and 37 feeds the sheet material P to a line position (the position of the sheet material P in its feeding direction) for the formation of images on the sheet material P, and at the same time, the carriage 50 is caused to move to the line position (the position perpendicular to the feeding direction of the sheet material P) by means of the carriage motor 80 so that the recording head 7 can face the image formation position. Subsequently, the recording head 7 discharges ink toward the sheet material P in accordance with signals from the electrical circuit board 9 for the formation of intended images.

(D) Sheet exhaust unit

The sheet exhaust unit 4 is arranged in such a manner that a transmission roller 40 abuts upon the feed roller 36, and, further, the transmission roller 40 abuts upon a sheet exhaust roller 41. Therefore, the driving force of the feed roller 36 is transmitted to the sheet exhaust roller 41 through the transmission roller 40. Also, a spur 42 arranged to be rotative following the sheet exhaust roller 41 is in contact with the sheet exhaust roller 41. With the structure described above, the sheet material P having images formed on the carriage unit 5 is nipped by the sheet exhaust roller 41 and spur 42 and carried and exhausted to a sheet exhaust tray or the like (not shown).

(E) Cleaning unit

The cleaning unit 6 comprises a pump 60 for cleaning the recording head 7, a cap 61 for suppressing the dryness of the recording head 7, and a power switch over arm 62 to switch over the application of the driving force from the feed roller 36 to the sheet supply unit 2 or to the pump 60. Unless the power switch over arm 62 is set for use of sheet supply or cleaning, the planetary gear (not shown) that rotates centering the axis of the feed roller 36 is fixed to a given position. Therefore, the driving force is not transmitted to the sheet supply unit and the pump 60. When the carriage 50 travels, the planetary gear is released by shifting the power switch over arm 62 in the direction indicated by an arrow A, and then, the planetary gear shifts in accordance with the normal or reverse rotation of the feed roller 36. In this way, when the feed roller 36 rotates normally, the driving force is transmitted to the sheet supply unit 2, and if it rotates reversely, the driving force is transmitted to the pump 60.

Now, with reference to FIG. 4 to FIG. 8C, FIG. 12A to FIG. 13C, FIG. 15, and FIG. 16, the detailed description will be made of each of the principal parts of the carriage unit 5, which presents the advantages and features of the present invention.

Figure 4:
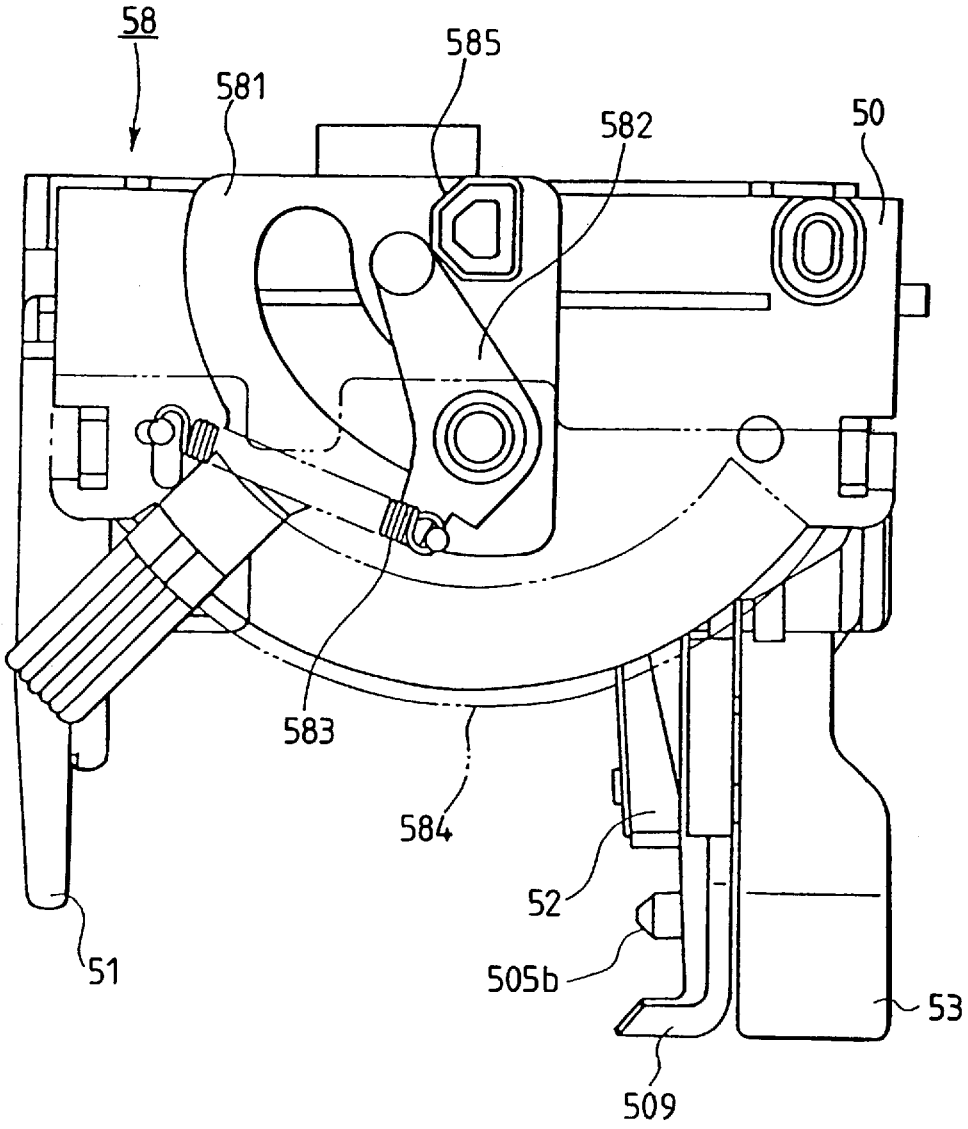
FIG. 4 is a plan view which shows the carriage unit of the recording apparatus in accordance with a first embodiment of the present invention, observed from its guide rail side.
Figure 5A:
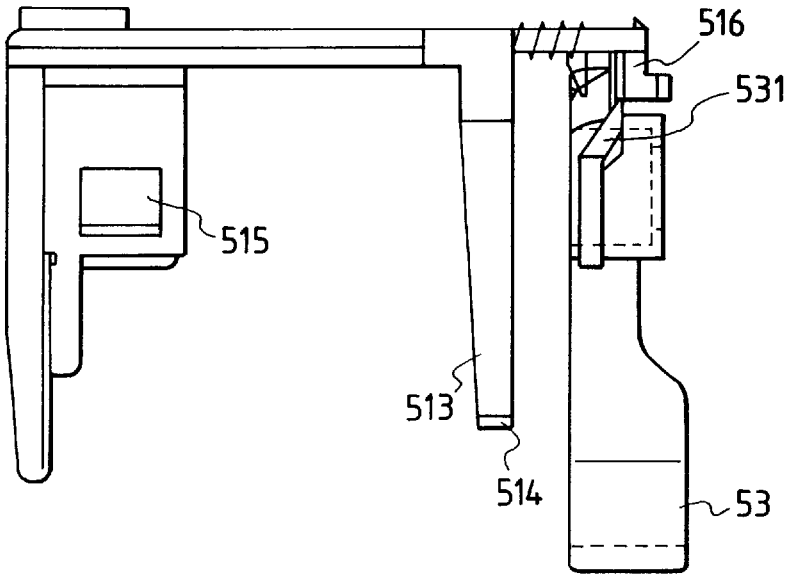
FIGS. 5A and 5B are structural views which show the principal part of the mounting and removing mechanism of a recording head of the recording apparatus in accordance with the first embodiment of the present invention.
Figure 5B:
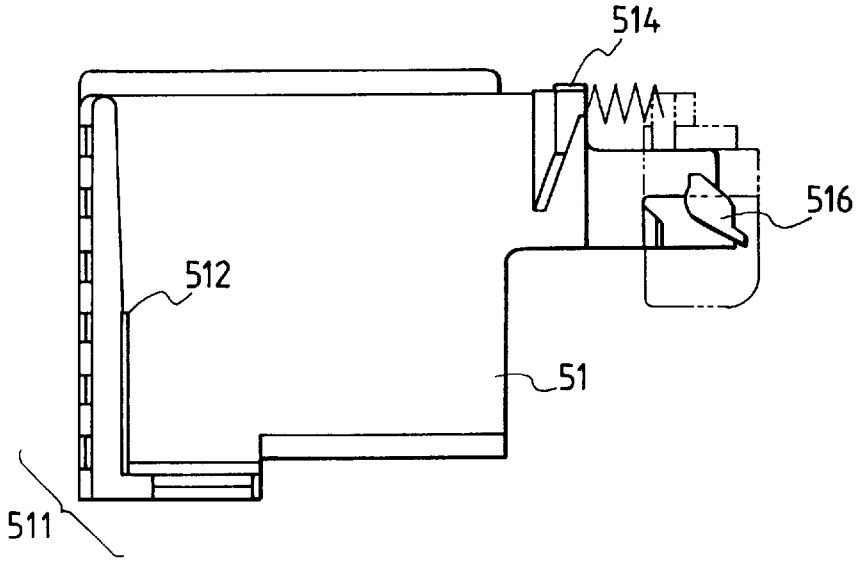
Figure 6A:
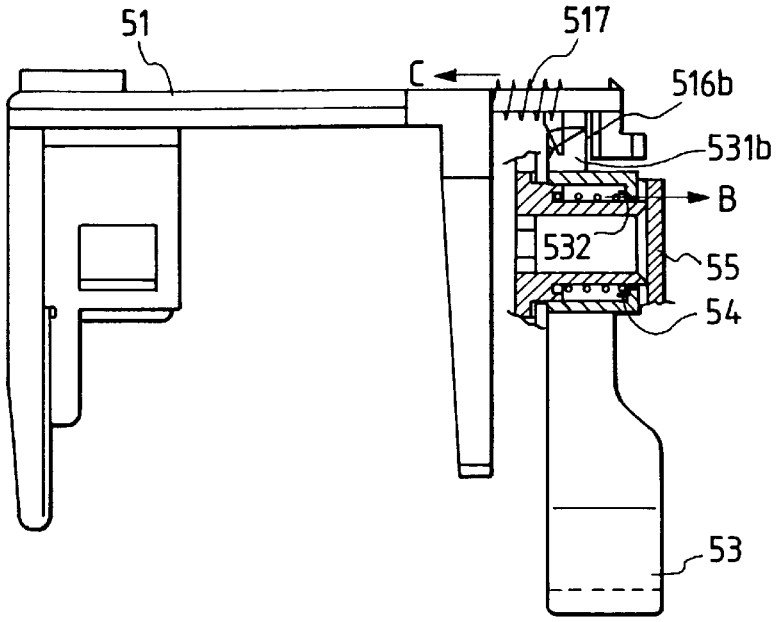
FIGS. 6A to 6C are views which illustrate the operation of the carriage attaching and detaching mechanism of the recording apparatus in accordance with the first embodiment of the present invention.
Figure 6B:
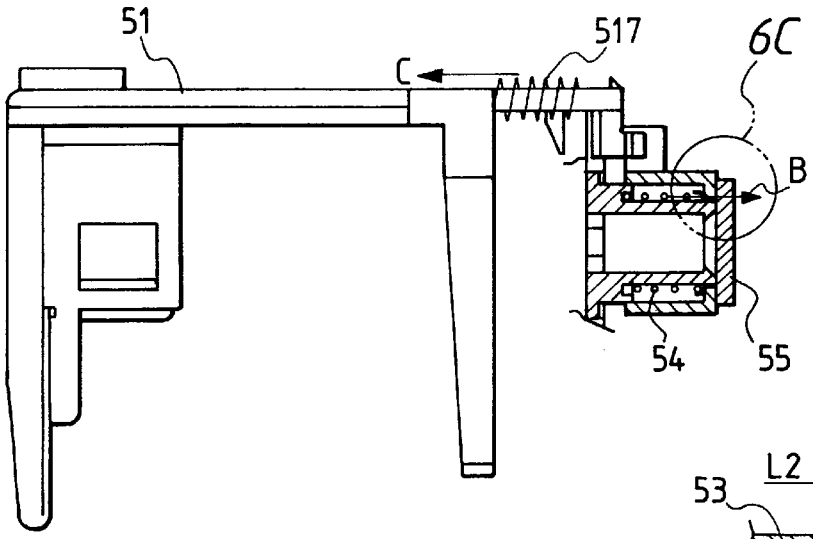
Figure 6C:
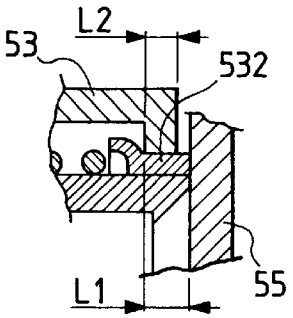
Figure 7A:
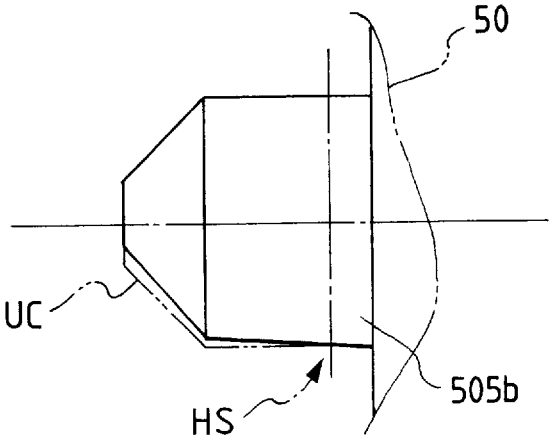
FIGS. 7A and 7B are views which illustrate the structure of the head fitting pin of the carriage of the recording apparatus in accordance with the first embodiment of the present invention.
Figure 7B:
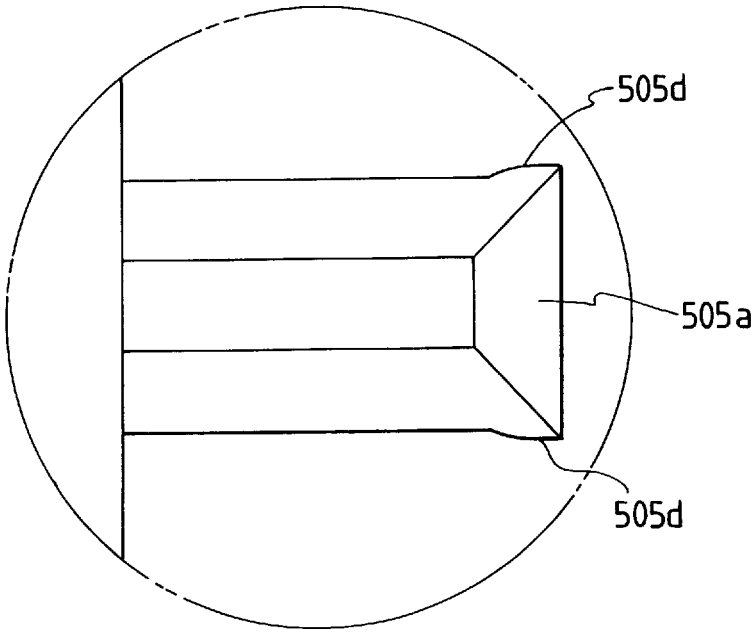
Figure 8A:
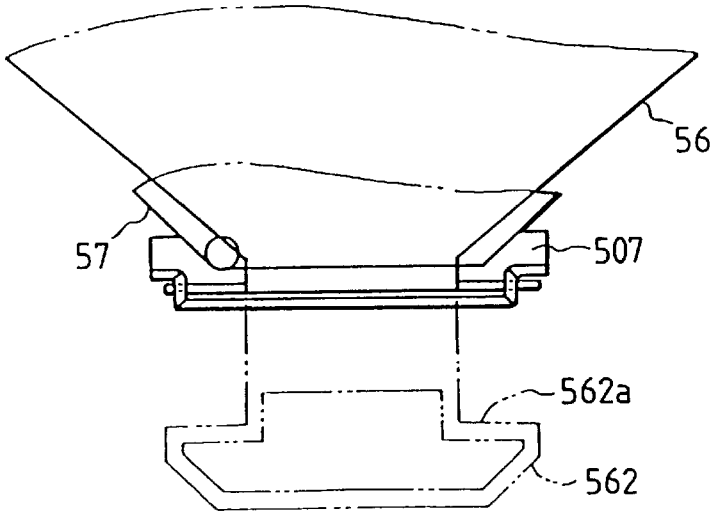
FIGS. 8A to 8C are views which illustrate the assembled state of the leading end of a flexible board of the recording apparatus in accordance with the first embodiment of the present invention.
Figure 8B:
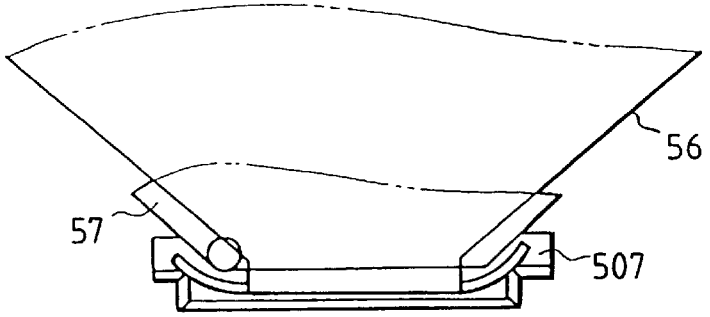
Figure 8C:
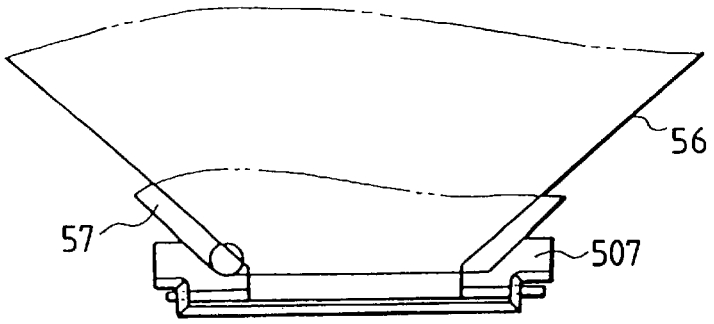

FIG. 4 is a plan view of the carriage unit 5 observed from its guide rail 82 side. FIGS. 5A and 5B are views which show the structure of the principal part of the mounting and removing mechanism of a recording head 7. FIGS. 6A to 6C are views which illustrate the operation of the carriage installation and removal mechanism shown in FIGS. 5A and 5B. FIGS. 7A and 7B are views which illustrate the structure of a head fitting pin 505 arranged on the carriage 50. FIGS. 8A to 8C are views which illustrate an assembled state of the leading end 562 of a flexible board 56.

The carriage unit 5 constitutes a unit with each of the components mounted on the carriage 50.

In FIG. 4, FIGS. 5A and 5B, FIGS. 13A to 13C, FIG. 15, and FIG. 16, the carriage unit 5 that serves as the mounting and removal unit for the recording head 7 comprises a carriage 50; a head holder 51 serving as the head holding unit; a base cover 52; a hook lever 53 serving as the operational unit; a contact spring 54 serving as biasing means; a hook cover 55 serving as stopper means; a flexible board 56; and a rubber pad 57.

The head holder 51 is structured to slide to the left and right sides with the recording head 7 mounted on it along the guide 501 arranged on the carriage 50 as looking at the respective figures. For the head holder 51, there are arranged a guide unit 511 that guides the recording head 7, and a pressure unit 512 that presses the recording head 7 to the contact surface 503 and positioning surface 504 of the side plate 502 serving as one side portion vertically planted on the carriage 50. Three points are provided for the side plate 502 of the carriage as the positioning surface, that is, the arrangement is made so that two points are formed on the base plate 72 in the vicinity of the nozzle unit 70 of the recording head 7, and one point is formed above the ink tank 3 of the recording head 7.

The contact surface 503 between the recording head 7 and the carriage 50 is arranged to be positioned within the triangle made by the three points that form the positioning surface 504. The pressing position of the pressure unit 512 of the head holder 51 resides within this triangle. Also, a guide arm 513 is arranged on the position opposite to the pressure unit 512 of the head holder 51. When the recording head 7 parts from the contact surface 503, this guide arm 513 acts upon the recording head 7. On the side plate 502 of the carriage 50, a rib 509 is arranged to dually function as a guide when the recording head 7 is mounted or removed and as a protector for the contact unit 561 and others of the flexible board 56, which will be described later, and hide them behind.

The recording head 7 is provided with a guide on the side face of the ink tank 3 as shown in FIGS. 12A to 12D, and mounted along the leading face of the guide arm 513. Then, in the predetermined position where the recording head 7 should be mounted, a recess 75 is provided for the guide 74 arranged for the recording head 7, and an extrusion 514 is provided for the guide arm 513 as regulating means, which fits into such recess 75 in order to regulate the position of the recording head 7. Further, an extrusion 76 is arranged on the bottom end of the recording head 7 on the nozzle unit side, while a recess 515 is provided for the head holder 51 as a receiving portion corresponding to the extrusion 76. In this way, when the recording head 7 is mounted, it is possible to avoid any event that the nozzle surface 70 may abut upon the platen 34 or the like. As a result, there is no possibility that the recording head 7 is damaged. Also, the clicking sense is obtainable when mounting the recording head, thus enhancing the reliability with which it is mounted. Here, as the extrusion 514 of the head holder 51 is hooked, the recording head 7 is not allowed to drop off from its nozzle side when detachably mounting the recording head 7. Therefore, it is possible to eliminate any sense of unstableness such as positional deviation after the recording head has been mounted.

In FIGS. 6A to 6C, the hook lever 53 is rotatively fixed to the side plate 502 of the carriage 50. At the rotational center of the hook lever 53, the contact spring 54 is provided to bias the hook lever 53 in the direction indicated by an arrow B through a spring stopper 532 serving as an intermediate pressure member. The biasing force of the contact spring 54 is one to three kilograms, and then, through the hook lever 53, it becomes the pressure force of the head holder 51 to be applied to the recording head 7. The hook cover 55 is installed to embrace the hook lever 53, thus holding the hook lever 53 so as not to let it fall off from the carriage 50.

As shown in FIGS. 5A and 5B and FIGS. 6A to 6C, the hook lever 53 and the head holder 51 are provided with cams 516 and 531 that abut upon each other. Then it is arranged that by the rotation of the hook lever 53, the head holder 51 can shift to the left and right as looking at FIGS. 5A and 5B and FIGS. 6A to 6C. Also, a release spring 517 is provided to bias the head holder 51 in the releasing direction indicated by an arrow C. Here, a pressure of 30 to 200 g is given at all times. As shown in FIGS. 6A to 6C, the pressing directions of the contact spring 54 and release spring 517 are opposite to each other and at right angles to the operational direction of the hook lever 53. Then, in a state that the recording head 7 is mounted, the abutting surfaces 516*b* and 531*b* of the cam 516 of the head holder 51 and the cam 531 of the hook lever 53 are made perpendicular to the pressing directions of the contact spring 54 and release spring 517.

In this respect, FIG. 6A shows the state that the recording head is mounted. FIG. 6B shows the state that the recording head is released (not mounted). FIG. 6C is an enlargement of the portion X indicated by a circle in FIG. 6B.

Now, the description will be made of the operation by means of the structure described above for detachably mounting the recording head 7.

When the recording head 7 is mounted, the head holder 51 is biased in the direction indicated by an arrow C by means of the release spring 517 as shown in FIG. 6A if the hook lever 53 is in a state that it has been raised upward as looking at the figure. Therefore, the head holder 51 shifts to the left side as looking at FIG. 6A so that it is ready for mounting a recording head 7. In this state, the recording head 7 is mounted, and then, if the hook lever 53 is rotated downward as looking at FIG. 6A, the cam 531 of the hook lever 53 acts upon the cam 516 of the head holder 51 to enable the head holder 51 to move the recording head 7 to the right side for the execution of positioning and electrical contact of the recording head 7. In this mounting condition of the recording head 7, the contact spring 54 biases the hook lever 53 in the direction indicated by an arrow B through the spring stopper 532. This biasing force becomes the pressure of the head holder 51 acting upon the recording head 7. With the recording head 7 being mounted in this state, the abutting surfaces 516*b* and 531*b* of the cam 516 of the head holder 51 and the cam 531 of the hook lever 53 are made perpendicular to the pressing directions of the contact spring 54 and release spring 517, hence maintaining the condition in which the recording head 7 is stably mounted. Further, when the recording head 7 is removed from the carriage unit 5 as shown in FIGS. 6A to 6C, the hook lever 53 is raised in the upper direction as looking at FIGS. 6A to 6C. Then the engagement of the abutting surfaces 516*b* and 531*b* that has checked the biasing force of the contact spring 54 is released. The hook lever 53 is allowed to shift to the right side now that the biasing force of the contact spring 54 is released. In this way, the biasing force of the contact spring 54 is transferred to the hook cover 55 through the spring stopper 532. Here, the structure is arranged to make the dimensions of the hook lever 53 and spring stopper 532 to be L1>L2 as shown in FIG. 6C. Therefore, the hook lever 53 is freed, and then, the biasing force of the release spring 517 acts upon the cams 516 and 531 to enable the hook lever 53 to shift to the release position perfectly. At the same time, the head holder 51 is caused to shift to the release position on the left side as looking at FIGS. 6A to 6C. The guide arm 513 of the head holder 51 presses the recording head 7 to the left side as looking at FIGS. 6A to 6C, hence making it possible to remove the recording head 7 from the carriage unit. In this way, the recording head 7 is completely released just by a one-touch operation of the hook lever 53 as has been described above.

In FIGS. 7A and 7B, FIGS. 12A to 12D, and FIG. 15, fitting pins 505*a* and 505*b* are provided for the side plate 502 of the carriage 50 in order to position the recording head 7. These two fitting pins 505*a* and 505*b* correspond to the fitting holes 77*a* and 77*b* arranged on the base plate 72 of the recording head 7, respectively. The base plate 72 of the recording head 7 is arranged to be inclined at an angle of approximately one to four degrees in the scanning direction of the carriage unit 15 beginning at the driving point of the recording head 7. In order to set the pins with the fitting holes 77*a* and 77*b* thus inclined, one of the fitting holes 77*a* is formed in square on the base plate 72 of the recording head 7, while the corresponding fitting pin 505*a* on the carriage 50 side is also made square but with a column 505*d* partly formed thereon. Further, the other fitting hole 77*b* is formed circular, while the corresponding fitting pin 505*b* on the carriage side is formed by cutting off a portion UC as an under cut needed for the provision of the intended configuration of the carriage so that it can fit into the circular hole in the position where the recording head 7 abuts upon the positioning surface 504 of the carriage. In this way, it is possible to position the recording head 7 exactly and smoothly even on the inclined base plate 72 without providing any complicated configuration. Here, the related parts are all tapered to make it possible for the contact surfaces 78 and 561 to slide from the position where the contact surface 561 of the flexible board 56 and the contact surface 78 of the recording head 7 begin to abut upon each other to a position HS where the head is set. Therefore, the contact surfaces 78 and 561 are refreshed each time the recording head 7 is removed or mounted. Thus it is possible to avoid the adhesion of dust particles or the like that may bring about the defective contact, among others.

On the contact surface 503 (see FIGS. 13A to 13C) arranged on the side plate 502 of the carriage 50, there is provided a rubber pad 57 formed by elastic material such as silicon rubber having a rubber hardness of 30 to 50 degrees, and on this rubber pad, the contact unit 561 of the flexible board 56 is arranged in order to effectuate the electrical contact with the recording head 7. Both rubber pad 57 and the flexible board 56 are positioned by use of the positioning pin 506 arranged on the side plate 502 of the carriage 50. Here, with the provision of a slit 563 on the side opposite to the contact portion 561 of the positioning unit of the flexible board 56, an arrangement is made so as not to allow the deformation or the like of the flexible board 56 to influence the contact unit 561 when this board is assembled. The leading end 562 of the contact unit 561 of the flexible board 56 is thinned to match the configuration of the base plate 72 of the recording head 7, and also, a hooking portion 562*a* is provided for the top end thereof. In this way, the contact unit 561 is configured in triangle, and then, closer to the top end, the number of the contact pads is made smaller decreasingly for the easier formation of signal lines in higher density. Thus, in addition, the processing of the leading end of the flexible board 56 becomes easier. On the side board 502 of the carriage 50, a slit hole 507 is arranged to receive the leading end 562 of the flexible board 56. As shown in FIGS. 8A to 8C, this leading end 562 is bent and inserted into the slit hole 507. When passing the slit hole 507, its top end portion becomes straight: this end is hooked thereby, and the board does not fall off. Also, with this structure, the end portion is freed. The contact unit 561 of the flexible board 56 is not made rigid. Therefore, this unit is in contact with the contact surface 78 (see FIGS. 12A to 12D) of the recording head 7 in good condition, and when the recording head 7 is mounted, the contact surface (see FIGS. 13A to 13C) of the carriage 50 is inserted into the cut off portion 79 (see FIGS. 12A to 12D) of the base plate 72 of the recording head 7 to form a contact point together with the contact surface 78 (see FIGS. 12A to 12D) inside the cut off portion 79 (see FIGS. 12A to 12D).

On the contact unit 561 of the flexible board 56, square contact pads 561*a* are arranged in the respective positions facing the contact pads of the recording head 7. Here, extruded portions 561*b* (hereinafter referred to as dimples) are formed by press or the like. When the recording head 7 is set on the carriage 50, the rubber pad 57 described earlier is deformed to enable the contact surface 78 of the recording head 7 and the contact unit 561 of the flexible board 56 to abut upon each other with a contact pressure of 20 to 70 g per pin. In this way, the recording head 7 is electrically connected with the main body of a printer.

The flexible board 56 is drawn along the side plate 502 of the carriage 50, and folded vertically to be fixed on the carriage 50 by means of the base cover 52. At this juncture, since an extrusion 564 (see FIGS. 13A to 13C) is arranged on the flexible board 56 to set it provisionally, it is possible to fix the flexible board 56 by hooking this extrusion 564 for the provisional setting on the carriage 50. Therefore, when the base cover 52 is mounted, the assembly is made efficiently. Further, on the base cover 52, pressure units 521 are arranged to prevent the positioning holes of the rubber pad 57 and flexible board 56 from being withdrawn from the respective fitting portions of the pins 506 on the carriage 50. Also, on the recording head 7, recesses 731 (see FIGS. 12A to 12D) are provided as escapes each for the positioning pin 506 and the extruded portion of the pressure unit 521 of the base cover 52. Therefore, the length of the positioning pin 506 and the thickness of the pressure unit 502 of the base cover 52 can be made greater accordingly. As a result, the rubber pad 57 and the flexible board 56 are positioned rigidly, while reliably preventing them from being withdrawn. The flexible board 56 is fixed to the chassis 8 by means of a flexible fixing plate 85 (see FIG. 2). Depending on the positions of the carriage 50, the curvature of the flexible board changes to transmit the head driving signals from the electrical circuit board 9 to the recording head 7 following the movement of the carriage 5.

With the arrangements described above, it is possible to mount the recording head 7 to or remove it from the carriage unit 15, hold and position it, and execute its electrical contact and other related operations easily and reliably with a simple and space-saving structure.

Figure 13C:
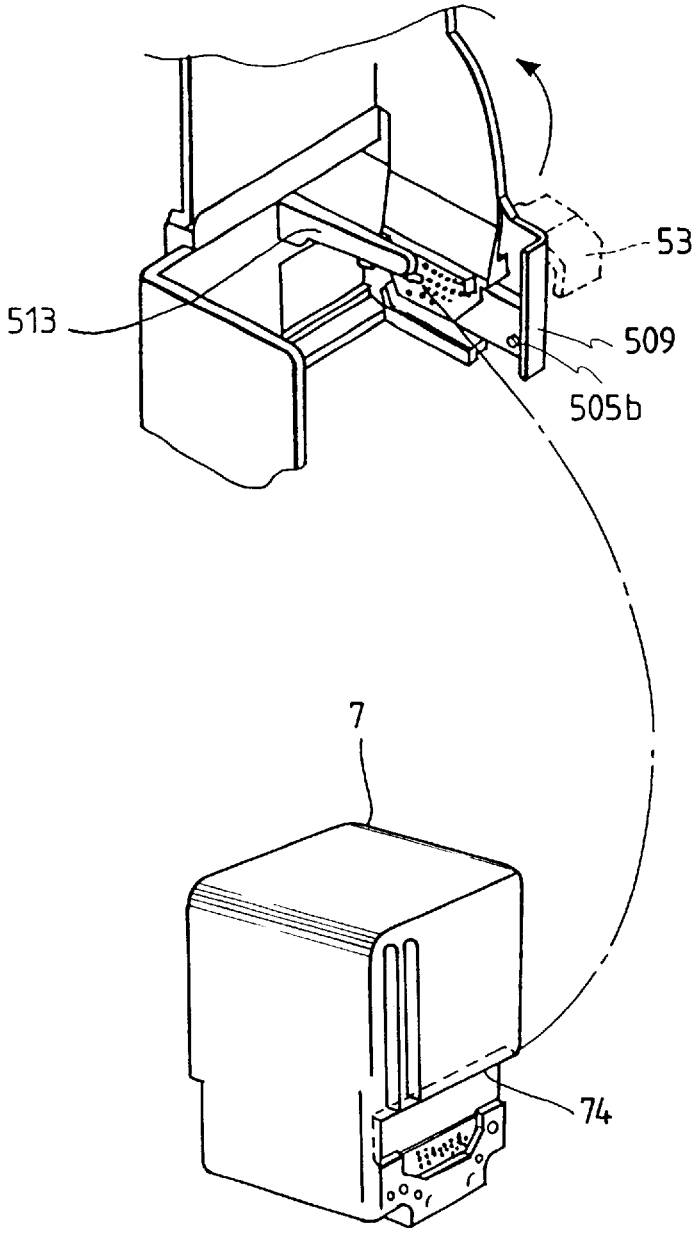
Figure 14A:
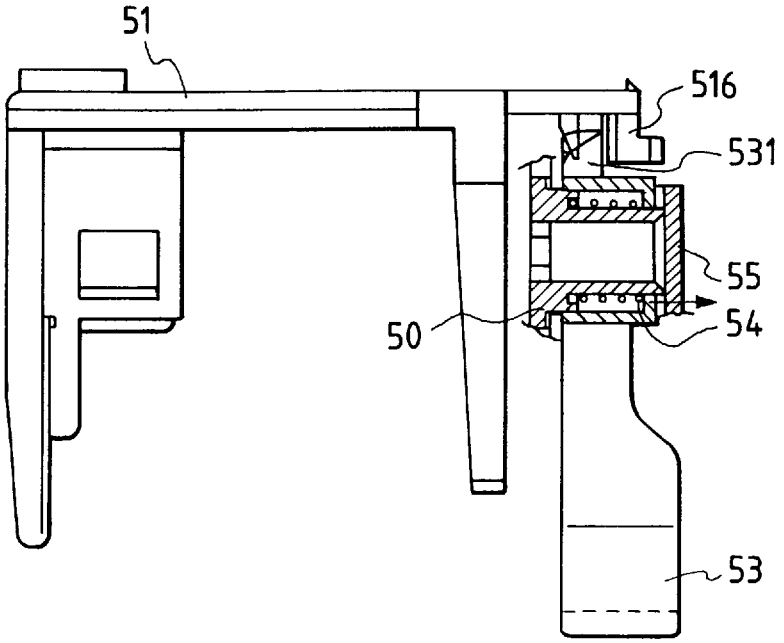
FIGS. 14A and 14B are front views showing a head mounting and removing mechanism in accordance with the prior art.
Figure 14B:
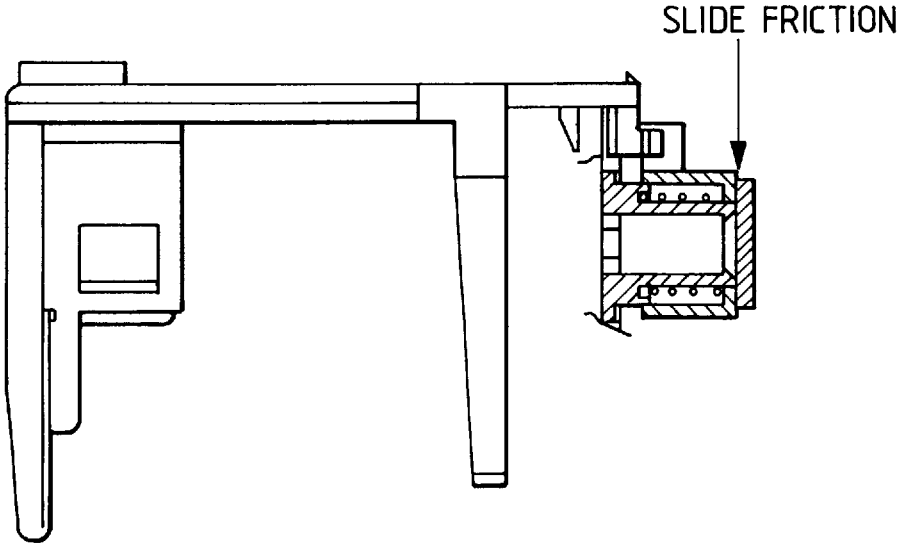
Figure 15:
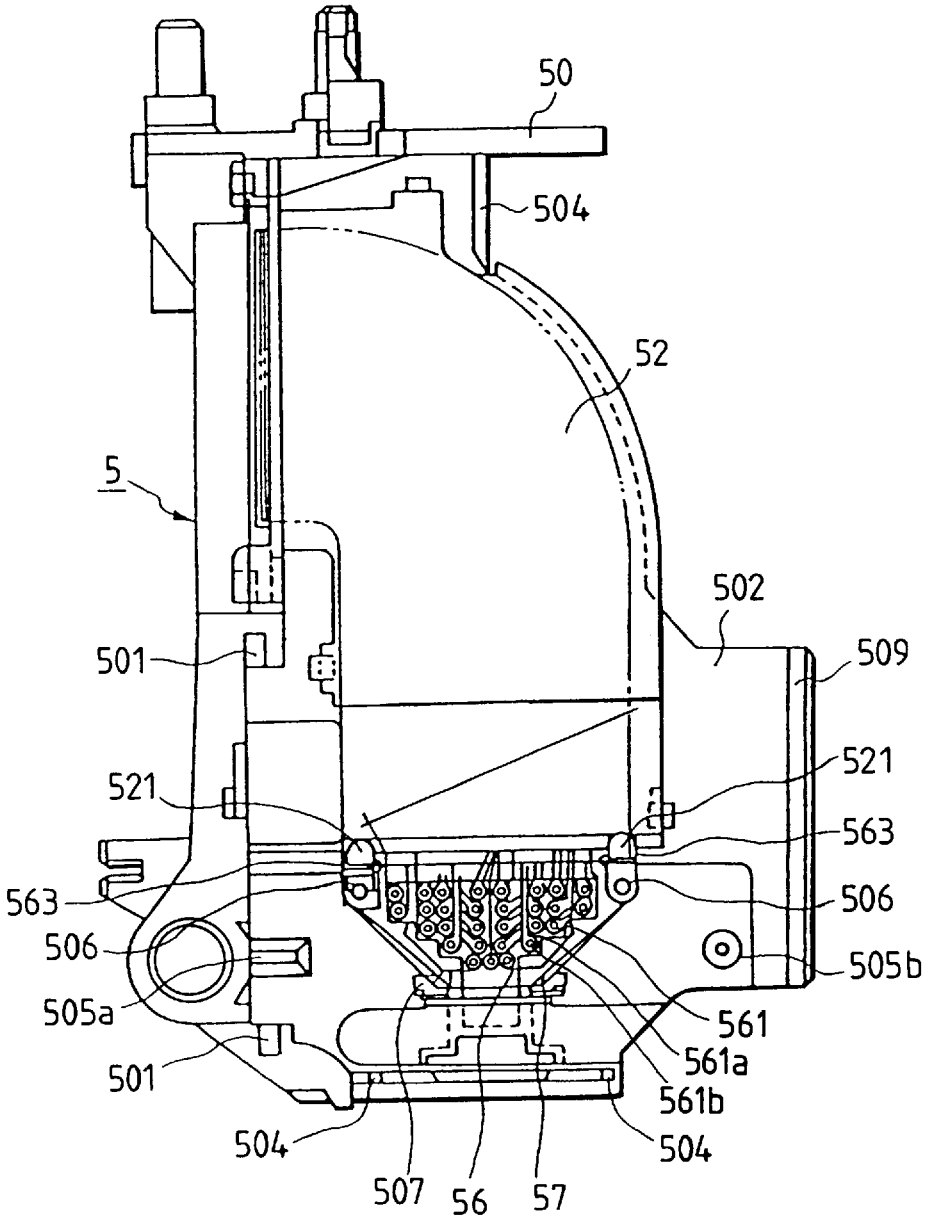
FIG. 15 is a side view which illustrates the structure of the contact unit of a carriage.
Figure 16:
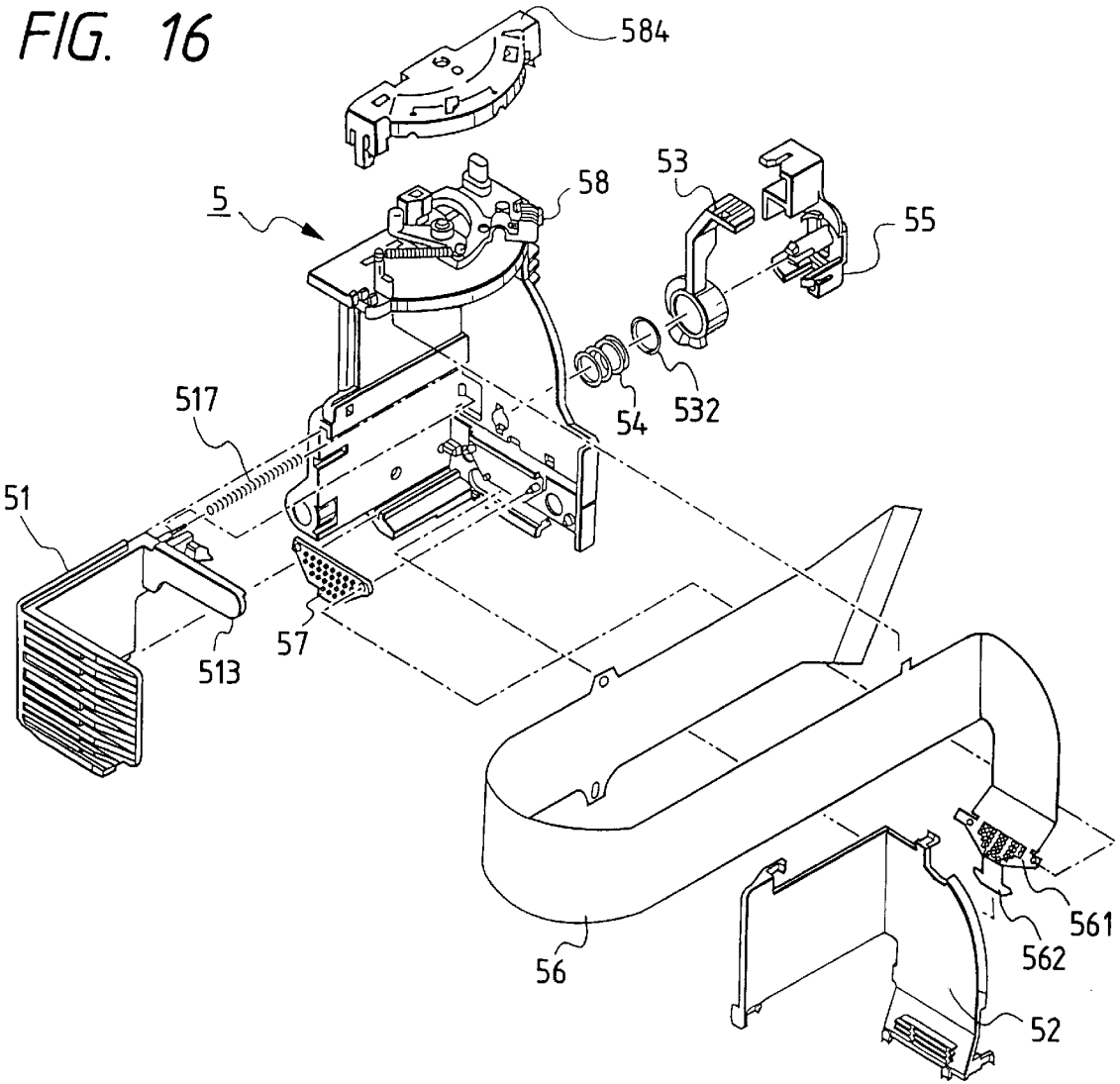
FIG. 16 is an exploded view which schematically shows a carriage unit.

FIGS. 13A to 13C are front views which show the carriage unit 5 at the time of head mounting and removal.

When the recording head 7 is mounted, the guide 74 of the recording head 7 is guided along the surface of the leading end of the guide arm 513 as shown in FIGS. 13A to 13C, thus arranging the recording head 7 in a predetermined position on the carriage. Then, as shown in FIG. 13B, the head holder 51 is on the left side if the hook lever 53 is in a state that it has been raised as looking at FIG. 13A. Consequently, the recording head 7 is ready to be mounted on the head mountable position of the carriage. In this state, the recording head 7 is mounted, and then, if the hook lever 53 is rotated downward as looking at FIG. 13A, the head holder 51 shifts to the recordable position on the right side together with the recording head 7 as looking at FIG. 13A. Thus the positioning, electrical contact, and other related operations are executed with respect to the recording head 7. In this condition, images can be formed on a sheet material P. Further, when the recording head 7 is removed from the carriage unit 15 as shown in FIG. 13B, the hook lever 53 is raised as looking at FIG. 13B. Then, with just one-touch, the head holder 51 shifts to the left side as looking at FIG. 13B, and then, the guide arm 513 of the head holder 51 presses the recording head 7 to the left side to enable the recording head 7 to be removed from the carriage unit 15.

Above the carriage 50, a gap adjustment unit 58 is installed in order to adjust the gap between the recording head 7 and a recording sheet P as shown in FIG. 4 and FIGS. 13A to 13C. The gap adjustment unit comprises an adjustment lever 581, a pressure lever 582, a pressure spring 583, and a top cover 584 (indicated by two-dot chain line in FIG. 4).

The adjustment lever 581 is rotatively arranged by inserting a pin (not shown) into a hole provided for the carriage 50. On the adjustment lever 581, polygonal sliding surfaces 585 are arranged, each in different distance from the rotational center of the adjustment lever, in accordance with the number of gap positions between the head and recording medium. The pressure lever 582 is rotative centering a pin arranged on the carriage 50 in order to bias each of the sliding surfaces 585 of the adjustment lever 581 toward the guide rail 82 by means of the pressure spring 583. By changing the sliding surfaces 585 of the adjustment lever 581, the carriage 50 rotates centering the guide shaft 81, thus setting the gaps changeable. The top cover 584 is fixed to the carriage 50 by means of nails arranged on both sides, respectively, to hold the adjustment lever 581, pressure lever 582, and others. Further, the leading end of the adjustment lever 581 is made elastic. When the specific portion of the leading end of the lever is hooked corresponding to the grooves (see FIGS. 13A to 13C) of the top cover 584, the adjustment lever 581 is fixed to make it possible to form a given gap between the recording head and a sheet material.

The carriage unit 5 can reciprocate for scanning by arranging the bearing of the carriage 50 to slide over the guide shaft 81 fixed to the chassis 8, and also, by allowing the adjustment lever 581 and the pressure lever 582 to slide on the guide rail 82 fixed to the chassis 8. On the back side of the carriage 50, a timing belt 83 is attached. The timing belt 83 is tensioned around a pulley 801 fixed to the shaft of the carriage motor 80 mounted on the chassis 8, and an idle pulley 83 fixed to the chassis 8 for use of tensioning the timing belt 83.

Now, with reference to FIGS. 9A to 9C to FIGS. 11A to 11C, the description will be made of the other embodiments of a recording apparatus in accordance with the present invention. In the description given below, the same reference marks are applied to the same constituents appearing in the first embodiment, and the description thereof will be omitted.

(Second Embodiment)

Figure 10A:
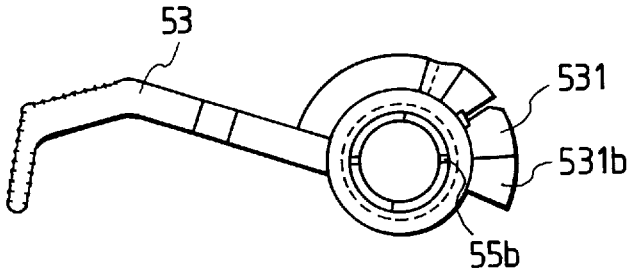
FIGS. 10A and 10B are side views of the hook lever represented in FIGS. 9A and 9B.
Figure 10B:
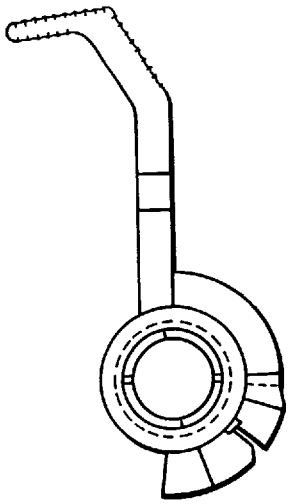

FIGS. 9A to 9C are views which illustrate the operation of the recording head mounting and removing mechanism of a recording apparatus in accordance with a second embodiment of the present invention. FIGS. 10A and 10B are side views of the hook lever represented in FIGS. 9A to 9C.

For the embodiment previously described, it is arranged that the hook lever 53 is freed when the hook cover 55 receives the biasing force of the contact spring 54 through the spring stopper 532 at the time of releasing. As shown i n FIGS. 9A to 9C, however, it may be possible to provide an extrusion 55*b* for the hook cover 55 and arrange receiving the biasing force of the contact spring 54 directly by such extrusion thus provided. In this case, the number of parts can be curtailed.

In this respect, FIG. 9A shows the state where the recording head is mounted. FIG. 9B shows the state where the record ing head is not mounted (that is, the released condition). FIG. 9C is an enlargement of the portion Y indicated by a circle in FIG. 9B. As shown in FIGS. 10A and 10B, a cut off portion is arranged for the hook lever 53 to receive the extrusion 55*b*. The angle of this cut off portion is arranged to correspond with the operational angle of the hook lever 53. Since the dimensions of the extrusion 55*b* and hook lever 53 are defined to be L1>L2, the hook lever is made free because the extrusion 55*b* receives the biasing force of the contact spring 54 directly when the recording head 7 is released.

Here, FIG. 10A shows the state where the recording head is mounted. FIG. 10B shows the state that the recording head is not mounted (that is, the released condition).

Any other structures than those described above are the same as the first embodiment.

(Third Embodiment)

Figure 11A:
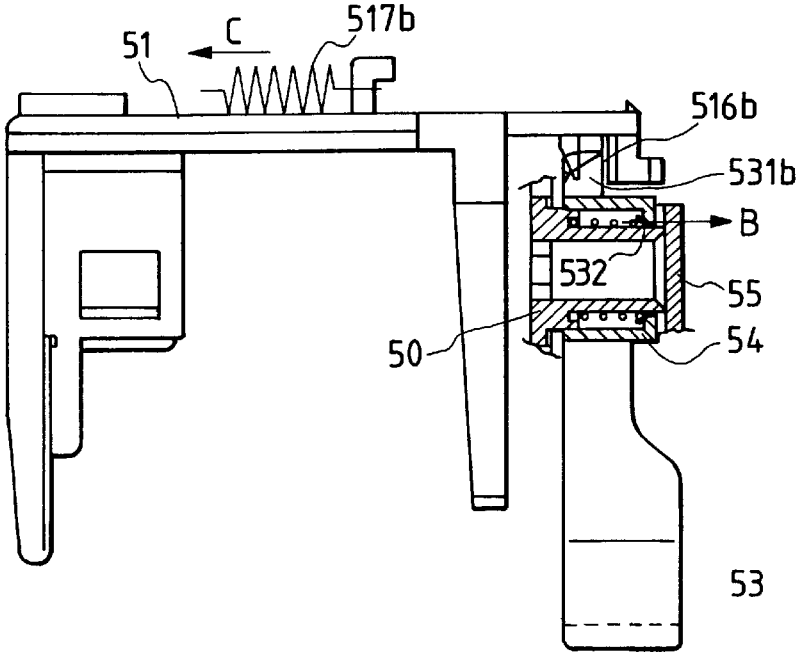
FIGS. 11A to 11C are views which illustrate the operation of the recording head mounting and removing mechanism of the recording apparatus in accordance with a third embodiment of the present invention.
Figure 11B:
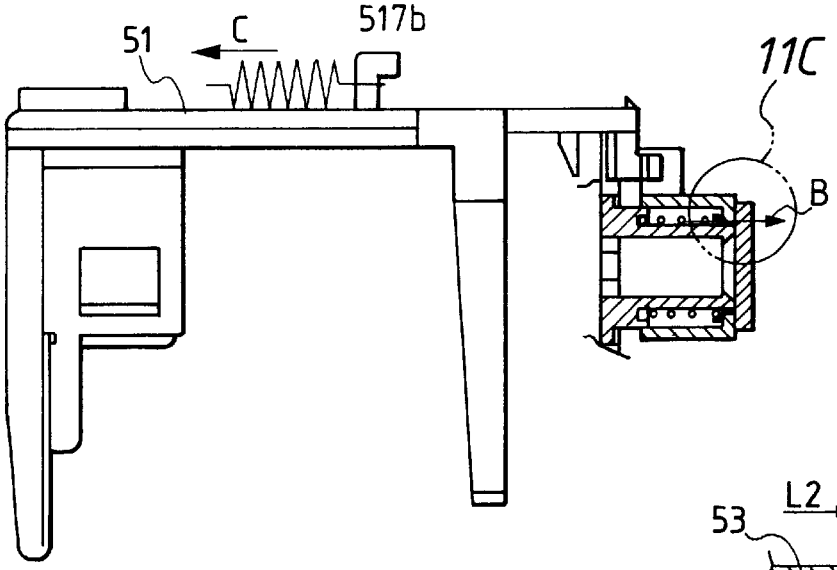
Figure 11C:
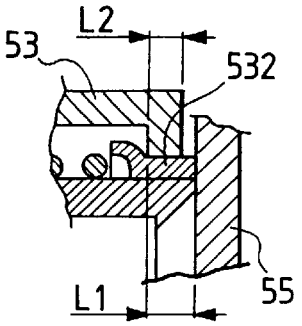
Figure 12A:
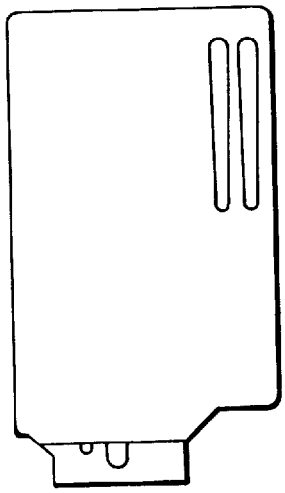
FIGS. 12A to 12D are views showing the structure of a head cartridge.
Figure 12B:
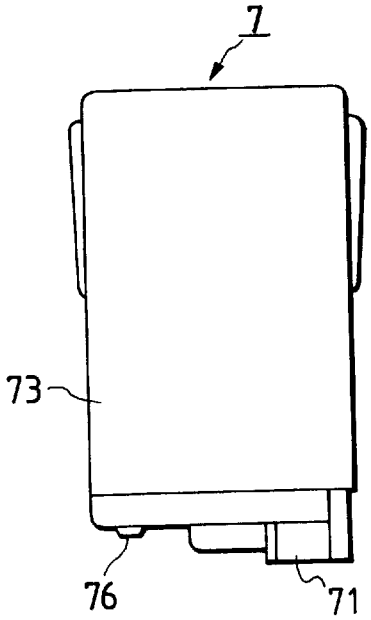
Figure 12C:
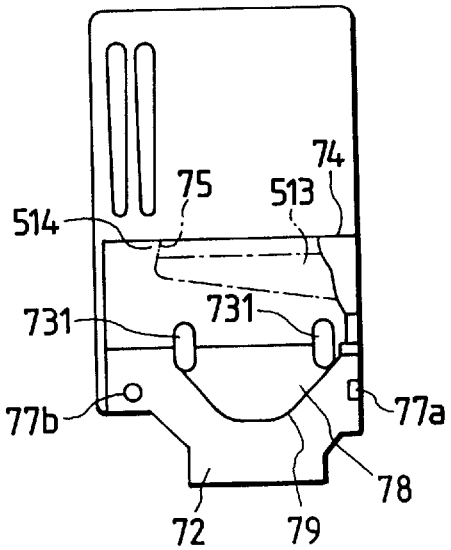
Figure 12D:
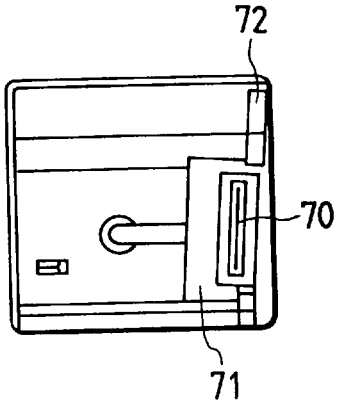

FIGS. 11A to 11C are views which illustrate the operation of the recording head mounting and removing mechanism of a recording apparatus in accordance with a third embodiment of the present invention.

In the embodiment previously described, a compression spring is used as the release spring 517 that biases the head holder 51. As shown in FIGS. 11A to 11C, however, it may be possible to use a tensioning spring instead. In this case, the freedom of design is increased.

A release spring 517*b* using a tensioning spring is installed by hooking its one end on the hooker arranged on the back side of the head holder 51, and the other end on a hooker (not shown) arranged on the carriage 50.

In this respect, FIG. 11A shows the state where the recording head is mounted. FIG. 11B shows the state where the recording head is not mounted (that is, the released condition). FIG. 11C is an enlargement of the portion Z indicated by a circle in FIG. 11B.

Any other structures a re the same as those of the first embodiment.

As described above, each of the embodiments makes it possible to remove a recording head from a carriage unit without any additional power from the user or the like once the operational unit is allowed to move to a given position where stopper means acts when the recording head is removed from the carriage unit. As a result, a head removal of the kind can be performed in just one action, thus enhancing the operativity, and carrying out the operation reliably with a simple and space-saving structure.

Also, in such case, the recording head can shift on the carriage to the position where its removal is possible or to the position where recording is executable by means of elastic biasing force without borrowing any additional power from the user. As a result, it is possible for the recording head to shift reliably to such head removal position or to such recording executable position. Hence there is no possibility that any damage is invited due to the event that the recording head may be hung up by a part of the carriage and left intact in an unstable condition on the way of removal or mounting.

Also, with the structure arranged to bias the head holding unit in the direction in which it parts further away from the one side portion at all times by use of a release spring serving as second biasing means, the position for a recording head to be mounted is kept remaining in the position from which a recording head has been removed, thus preventing the possibility of any erroneous insertion of a recording head or the like.

In addition, the biasing directions of the contact spring serving as biasing means and the release spring serving as second biasing means, and the direction in which the operational unit is made movable are substantially made rectangular to each other, while the biasing directions of the biasing means and the second biasing means are substantially perpendicular to the abutting surfaces of the head holding unit and the operational unit when a recording head is mounted on the carriage unit. Therefore, the recording head is not allowed to shift in the releasing direction by means of the biasing force of the biasing means or second biasing means once the recording head is in a state of being mounted on the carriage unit.

What is clamed is:

1. An apparatus having a carriage capable of mounting and removing a head member, said carriage comprising:

one side portion provided with a positioning portion to position said head member;

a head holding portion for holding said head member, said head holding portion being relatively movable with respect to said one side portion;

a relatively moving mechanism portion for performing the relative movement, said mechanism portion engaging with said head holding portion to move said head holding portion relatively with respect to said one side portion;

first biasing means for biasing said head holding portion in the same direction as the direction in which said head holding portion approaches said one side portion;

stopper means for regulating the biasing force of said first biasing means in a given position, and causing the biasing force of said first biasing means not to be exerted on said relatively moving mechanism portion in said given position; and second biasing means for biasing said head holding portion in the same direction as that in which said head holding portion parts further away from said one side portion.

2. A recording apparatus according to claim 1, wherein the directions of the biasing force of said first biasing means and the biasing force of said second biasing means are opposite to each other.

3. A recording apparatus according to claim 1, wherein at least one of the directions of the biasing force of said first biasing means and the biasing force of said second biasing means, and an operational direction of said relatively moving mechanism portion are substantially rectangular to each other.

4. A recording apparatus according to claim 3, wherein at least one of the direction of the biasing force of said first biasing means and said second biasing means is substantially perpendicular to the abutting surfaces of said head holding portion and said relatively moving mechanism portion in the state that said head member is mounted on said carriage.

5. A recording apparatus according to claim 1, wherein said head member is an ink jet recording head for discharging ink from the ink discharge ports.

6. A recording apparatus according to claim 1, wherein said head member is an ink jet recording head provided with electrothermal transducing elements to discharge ink from the ink discharge ports by means of thermal energy generated by said electrothermal transducing elements.

7. A recording apparatus according to claim 1, wherein said head member is a reading head for reading image information form a source document.

8. A recording apparatus comprising:

a carriage capable of mounting and removing a recording head for forming images on a recording medium, said carriage comprising:

one side portion provided with a positioning portion for said carriage to position said recording head, and a contact unit for electrical contact with said recording head;

a head holding portion for holding said recording head, said head holding portion being arranged to be movable relatively with respect to said one side portion;

a relatively moving mechanism portion for performing the relative movement, said mechanism portion engaging with said head holding portion to move said head holding portion relatively with respect to said one side portion;

first biasing means for biasing said head holding portion in the same direction as the direction in which said head holding portion approaches said one side portion;

stopper means for regulating the biasing force of said first biasing means in a given position and causing the biasing force of said first biasing means not to be exerted on said relatively moving mechanism portion in said given position; and second biasing means for biasing said head holding portion in the same direction as that in which said head holding portion parts further away from said one side portion.

9. A recording apparatus according to claim 8, wherein the directions of the biasing force of said first biasing means and the biasing force of said second biasing means are opposite to each other.

10. A recording apparatus according to claim 8, wherein at least one of the directions of the biasing force of said first biasing means and the biasing force of said second biasing means, and an operational direction of said relatively moving mechanism portion are substantially rectangular to each other.

11. A recording apparatus according to claim 10, wherein at least one of the direction of the biasing force of said first biasing means and said second biasing means is substantially perpendicular to the abutting surface of said head holding portion and said relatively moving mechanism portion in the state that said recording head is mounted on said carriage.

12. A recording apparatus according to claim 8, wherein said recording head is an ink jet recording head for discharging ink from the ink discharge ports.

13. A recording apparatus according to claim 8, wherein said recording head is an ink jet recording head provided with electrothermal transducing elements to discharge ink from the ink discharge ports by means of thermal energy generated by said electrothermal transducing elements.

14. A recording apparatus comprising:

a carriage capable of mounting and removing a recording head for forming images on a recording medium said carriage comprising:

one side portion provided with a positioning portion for said carriage to position said recording head, and a contact unit for electrical contact with said recording head;

a head holding portion for holding said recording head, said head holding portion being arranged to be movable relatively with respect to said one side portion;

a relatively moving mechanism portion for performing the relative movement, said mechanism portion engaging with said head holding portion to move said head holding portion relatively with respect to said one side portion;

first biasing means for biasing said head holding portion in the same direction as the direction in which said head holding portion approaches said one side portion;

stopper means for regulating the biasing force of said first biasing means in a given position and causing the biasing force of said first biasing means not to be exerted on said relatively moving mechanism portion in said given position;

second biasing means for biasing said head holding portion in the same direction as that in which said head holding portion parts further away from said one side portion; and intermediate pressure means arranged between said first biasing means and said head holding portion.

15. A recording apparatus according to claim 14, wherein said first biasing means acts upon said head holding portion through said intermediate pressure means and said relatively moving mechanism portion, and said stopper means regulates the biasing force of said first biasing means in the given position through said intermediate pressure means, and then, the biasing force of said first biasing means is not exerted on said relatively moving mechanism portion.

16. A recording apparatus according to claim 15, wherein said relatively moving mechanism portion and said intermediate pressure means are moveable in parallel to the direction of biasing force of said first biasing means, and said stopper means is not allowed to function in the state that said recording head is mounted on said carriage, and when said recording head is removed from said carriage, said relatively moving mechanism portion and said intermediate pressure means shift, while said stopper means is in said given position and functions.

17. A recording apparatus according to claim 14, wherein the directions of the biasing force of said first biasing means and the biasing force of said second biasing means are opposite to each other.

18. A recording apparatus according to claim 14, wherein at least one of the directions of the biasing force of said first biasing means and the biasing force of said second biasing means, and an operational direction of said relatively moving mechanism portion are substantially rectangular to each other.

19. A recording apparatus according to claim 18, wherein at least one of the direction of the biasing force of said first biasing means and said second biasing means is substantially perpendicular to the abutting surfaces of said head holding portion and said relatively moving mechanism portion in the state that said recording head is mounted on said carriage.

20. A recording apparatus according to claim 14, wherein said recording head is an ink jet recording head for discharging ink from the ink discharge ports.

21. A recording apparatus according to claim 14, wherein said recording head is an ink jet recording head provided with electrothermal transducing elements to discharge ink from the ink discharge ports by means of thermal energy generated by said electrothermal transducing elements.

22. An apparatus having a carriage capable of mounting and removing a head member, said carriage comprising:

one side portion provided with a positioning portion for said carriage to position said head member;

a head holding portion for holding said head member, said head holding portion being relatively movable with respect to said one side portion;

a relatively moving mechanism portion for performing the relative movement, said mechanism portion engaging with said head holding portion to move said head holding portion relatively with respect to said one side portion;

a regulating portion for regulating a biasing force between said head holding portion and said one side portion in a given position, and causing the biasing force not be exerted on said relatively moving mechanism portion in said given position; and driving means for moving said head holding portion in the same direction as the direction in which said head holding portion parts further away from said one side portion.

23. An apparatus according to claim 22, wherein said head member is an ink jet recording head for discharging ink from the ink discharge ports.

24. An apparatus according to claim 22, wherein said head member is an ink jet recording head provided with electrothermal transducing elements to discharge ink from the ink discharge ports by means of thermal energy generated by said electrothermal transducing elements.

25. An apparatus according to claim 22, wherein said head member is a reading head for reading image information from a source document.

* * * * *

UNITED STATES PATENT AND TRADEMARK OFFICE

CERTIFICATE OF CORRECTION

PATENT NO. : 5,872,581

DATED : February 16, 1999

INVENTOR(S) : YANAGI ET AL.

It is certified that error appears in the above-identified patent and that said Letters Patent is hereby corrected as shown below:

COLUMN 12:

Line 10, "triangle," should read --triangle form,--.

COLUMN 14:

Line 18, "i" should be deleted.

Line 19, "n" should read --in--.

Line 26, "record ing" should read --recording--.

Line 64, "ar e" should read --are--.

COLUMN 16:

Line 23, change "form" to --from--.

UNITED STATES PATENT AND TRADEMARK OFFICE

CERTIFICATE OF CORRECTION

PATENT NO. : 5,872,581
DATED : February 16, 1999
INVENTOR(S) : Yanagi et al

It is certified that error appears in the above-identified patent and that said Letters Patent is hereby corrected as shown below:

Column 17, line 15, "medium" should read --medium,--.

Signed and Sealed this

Fourteenth Day of September, 1999

*Attest:*

Q. TODD DICKINSON

*Attesting Officer*

*Acting Commissioner of Patents and Trademarks*